US011871794B2

(12) United States Patent
Qiu

(10) Patent No.: US 11,871,794 B2
(45) Date of Patent: Jan. 16, 2024

(54) ATOMIZER OF ELECTRONIC CIGARETTE PROVIDING CHILD PROTECTION FUNCTION

(71) Applicant: JOYETECH EUROPE HOLDING GMBH, Zug (CH)

(72) Inventor: Weihua Qiu, Changzhou (CN)

(73) Assignee: JOYETECH EUROPE HOLDING GMBH, Zug (CH)

( * ) Notice: Subject to any disclaimer, the term of this patent is extended or adjusted under 35 U.S.C. 154(b) by 1274 days.

(21) Appl. No.: 16/463,361

(22) PCT Filed: Nov. 22, 2016

(86) PCT No.: PCT/CN2016/106770
§ 371 (c)(1),
(2) Date: May 22, 2019

(87) PCT Pub. No.: WO2018/094564
PCT Pub. Date: May 31, 2018

(65) Prior Publication Data

US 2019/0350263 A1 Nov. 21, 2019

(51) Int. Cl.

| | |
|---|---|
| ***A24F 40/49*** | (2020.01) |
| ***A24F 40/42*** | (2020.01) |
| ***A24F 40/485*** | (2020.01) |
| *A24F 40/10* | (2020.01) |

(52) U.S. Cl.
CPC ..... *A24F 40/49* (2020.01); *A24F 40/42* (2020.01); *A24F 40/485* (2020.01); *A24F 40/10* (2020.01)

(58) Field of Classification Search
CPC ..... A24F 40/49; A24F 40/10; A24F 40/42; A24F 40/485
See application file for complete search history.

(56) References Cited

U.S. PATENT DOCUMENTS

| | | | | |
|---|---|---|---|---|
| 10,021,917 | B2 * | 7/2018 | Dai | H05B 3/44 |
| 10,064,433 | B2 * | 9/2018 | Li | H05B 3/0014 |
| 10,125,004 | B2 * | 11/2018 | Li | B67D 3/0025 |
| 2014/0182612 | A1 | 7/2014 | Chen | |

(Continued)

FOREIGN PATENT DOCUMENTS

| | | |
|---|---|---|
| CN | 205196994 U | 5/2016 |
| CN | 105876869 A | 8/2016 |

(Continued)

*Primary Examiner* — Hae Moon Hyeon
(74) *Attorney, Agent, or Firm* — Cheng-Ju Chiang

(57) ABSTRACT

An atomizer includes a liquid storage assembly and an atomizing assembly. The liquid storage assembly includes a liquid storage tube internally provided with a liquid storage chamber, a liquid outlet opening communicating with the liquid storage chamber, and a sealing member movably received in the liquid storage chamber. The atomizing assembly includes an atomizing chamber and a pushing member. When the liquid storage assembly and the atomizing assembly are separated, the sealing member is in a first state in which the sealing member seals the liquid outlet opening. When the liquid storage assembly and the atomizing assembly are connected, the pushing member abuts against the sealing member to drive the sealing member to move to a second state in which the sealing member is separated from the liquid outlet opening.

17 Claims, 16 Drawing Sheets

(56) References Cited

U.S. PATENT DOCUMENTS

| | | | | |
|---|---|---|---|---|
| 2015/0007836 | A1* | 1/2015 | Li | A24F 40/46 131/329 |
| 2016/0183597 | A1* | 6/2016 | Li | H05B 1/0244 392/404 |
| 2018/0000156 | A1* | 1/2018 | Qiu | A24F 40/40 |
| 2018/0116287 | A1* | 5/2018 | Dai | H05B 3/44 |
| 2020/0146351 | A1* | 5/2020 | Rogan | A24F 40/42 |

FOREIGN PATENT DOCUMENTS

| | | | |
|---|---|---|---|
| CN | 205432130 | U | 8/2016 |
| CN | 205432131 | U | 8/2016 |
| CN | 205456062 | U | 8/2016 |
| CN | 105919163 | A | 9/2016 |
| CN | 205648912 | U | 10/2016 |
| FR | 2034123 | A1 | 12/1970 |
| WO | 2010/094305 | A1 | 8/2010 |

* cited by examiner

ATOMIZER OF ELECTRONIC CIGARETTE PROVIDING CHILD PROTECTION FUNCTION

CROSS REFERENCE TO RELATED APPLICATION

This application is a 35 U.S.C. § 371 National Phase conversion of International (PCT) Patent Application No. PCT/CN2016/106770, filed on Nov. 22, 2016. The contents of the above-identified application are incorporated herein by reference. The PCT International Patent Application was filed and published in Chinese.

TECHNICAL FIELD

The present disclosure relates to the technical field of electronic cigarettes, and in particular, to a liquid storage assembly, an atomizer and an electronic cigarette having the same.

BACKGROUND

Nowadays, electronic cigarettes are more and more popular among users, and their market share is increasing year by year. However, as the population of users continues to expand, the chances of children being exposed to electronic cigarettes increase. The electronic cigarette mainly includes a liquid storage assembly and an atomizing assembly, and the two are generally detachably connected by a screw connection, a plug connection or a magnetic connection. The children can open them only by a single action. The liquid storage chamber in the liquid storage assembly is often in open state and does not have the function of automatic sealing. Once the liquid storage assembly is detached, the cigarette liquid in the liquid storage chamber is easily exposed, and the children are extremely easy to contact or even ingest the cigarette liquid, thereby generating safety hazards due to poor protection.

SUMMARY

In view of the above, it is necessary to provide a liquid storage assembly, an atomizer and an electronic cigarette having the same. When the liquid storage assembly and the atomizing assembly are connected for use, the liquid storage chamber is opened to achieve normal operations. When the liquid storage assembly and the atomizing assembly are separated, the liquid storage chamber is sealed for achieving child protection function.

The technical solution adopted by the present disclosure to solve the above problem is: a liquid storage assembly is configured for use in an atomizer of an electronic cigarette. The atomizer further includes an atomizing assembly. The liquid storage assembly includes a liquid storage tube internally provided with a liquid storage chamber, a liquid outlet opening communicating with the liquid storage chamber and a sealing member movably received in the liquid storage chamber. The atomizing assembly includes an atomizing chamber and a pushing member. When the liquid storage assembly and the atomizing assembly are separated, the sealing member is in a first state in which the sealing member seals the liquid outlet opening. When the liquid storage assembly and the atomizing assembly are connected, the pushing member abuts against the sealing member to drive the sealing member to move to a second state in which the sealing member is at least partially separated from the liquid outlet opening, so that the liquid outlet opening is opened and the liquid storage chamber is in communication with the atomizing chamber.

Further, the liquid storage assembly further includes an elastic member received in the liquid storage chamber. One end of the elastic member elastically abuts against the sealing member, the other end of the elastic member elastically abuts against an inner wall of the liquid storage chamber. When the liquid storage assembly and the atomizing assembly are connected, the pushing member drives the sealing member to compress the elastic member. When the liquid storage assembly and the atomizing assembly are separated, the sealing member is reset to the first state under the elastic force of the elastic member.

Further, the liquid storage tube is further provided internally with at least one air outlet passage. The air outlet passage is isolated from the liquid storage chamber. When the liquid storage assembly and the atomizing assembly are connected, the air outlet passage is in communication with the atomizing chamber.

Further, an inner wall of the liquid storage chamber is provided with a first positioning step. A lower end of the sealing member is provided outwardly with a second positioning step along the circumferential direction of the sealing member for engaging in the liquid outlet opening. One end of the elastic member elastically resists the first positioning step, the other end of the elastic member elastically resists the second positioning step. When the sealing member is in the first state, the second positioning step seals the liquid outlet opening. When the sealing member is in the second state, the second positioning step compresses the elastic member and is separated from the liquid outlet opening.

Further, an upper end of the sealing member is provided outwardly with a positioning flange along the circumferential direction of the sealing member. The positioning flange is supported on the first positioning step.

Further, the sealing member is provided with a liquid injection hole communicating with the liquid storage chamber, and the liquid storage assembly further includes a blocking member mounted to the liquid injection hole.

Further, a seal ring is disposed between the second positioning step and the bottom of the sealing member.

Further, the liquid storage assembly further includes a bottom cover having an opening at a lower end. The bottom cover is disposed at a lower end of the liquid storage tube. The liquid outlet opening is provided in the upper surface of the bottom cover.

Further, the upper surface of the bottom cover is further provided with an air outlet groove communicating with the air outlet passage.

Further, the sealing member is provided with a first sleeve portion and a second sleeve portion. The first sleeve portion is slidably sleeved on an outer wall of the air outlet passage. The second sleeve portion is in communication with the air outlet passage. One end of the second sleeve portion opposite to the first sleeve portion passes through the liquid outlet opening. When the sealing member is in the first state, a step surface between the first sleeve portion and the second sleeve portion seals the liquid outlet opening.

Further, the sealing member is provided with at least one liquid guiding groove. When the sealing member is in the second state, the liquid outlet opening communicates with the liquid storage chamber through the liquid guiding groove.

Further, the liquid storage assembly further includes a pressing plate disposed on the upper surface of the sealing member. The pressing plate is provided with a liquid passing hole corresponding to the liquid guiding groove.

Further, the liquid outlet opening is defined in a side wall of the liquid storage tube. The sealing member is vertically disposed in the liquid storage chamber. One end of the elastic member elastically abuts against the sealing member, the other end of the elastic member elastically abuts against a side wall of the liquid storage chamber opposite to the liquid outlet opening.

Further, a side wall of the sealing member is provided with a resisting portion extending away from the elastic member and slidably passing through the liquid outlet opening. One end of the resisting portion away from the elastic member is provided with a wedge-shaped surface facing downward.

Further, the liquid outlet opening is defined in a side wall of the liquid storage tube. One end of the elastic member elastically abuts against a bottom wall of the sealing member, the other end of the elastic member elastically abuts against a top wall of the liquid storage chamber. A side wall of the sealing member is closely attached to an inner wall of the liquid storage tube having the liquid outlet opening. The side wall of the sealing member is provided with a resisting portion which extends out from the liquid outlet opening and is moveable in the liquid outlet opening upward and downward.

Further, the sealing member is made of a magnetic material, a portion of the pushing member for abutting against the sealing member is also made of a magnetic material.

An atomizer including an atomizing assembly and the above liquid storage assembly. The atomizing assembly includes an atomizing chamber and a pushing member.

Further, the liquid storage tube is further provided internally with at least one air outlet passage. The air outlet passage is isolated from the liquid storage chamber. When the liquid storage assembly and the atomizing assembly are connected, the air outlet passage is in communication with the atomizing chamber.

Further, the atomizing assembly further includes an outer sleeve detachably connected to the liquid storage tube. The pushing member is received at an upper end of the outer sleeve. The atomizing chamber is formed by an inner space of the outer sleeve. A first air inlet hole is defined in a side wall of the outer sleeve. An air inlet groove is defined in a side wall of the pushing member. When the outer sleeve and the liquid storage tube are connected, the first air inlet hole, the atomizing chamber, the air inlet groove and the air outlet passage are communicated sequentially.

Further, an upper end of the pushing member is provided with a liquid inlet groove. A mounting hole is defined in a side wall of the pushing member along a radial direction of the pushing member and located below the liquid inlet groove. The mounting hole is communicated with the liquid inlet groove and the air inlet groove. When the outer sleeve and the liquid storage tube are connected, the upper end of the pushing member replaces the sealing member to seal the liquid outlet opening such that the mounting hole communicates with the liquid storage chamber through the liquid inlet groove and the air inlet groove communicates with the air outlet passage through the mounting hole.

Further, the atomizing assembly further includes an atomizing base received at a lower end of the outer sleeve. A side wall of the atomizing base is provided with a second air inlet hole corresponding to the first air inlet hole and communicating with the atomizing chamber.

Further, an outer wall of the pushing member is provided with a flange along the circumferential direction of the pushing member. The pushing member is connected to the atomizing base via the flange by an interference fit, the air inlet groove is defined in the flange.

Further, the atomizing assembly further includes an atomizing cover. An inner space of the atomizing cover forms the atomizing chamber. The pushing member is received in the atomizing cover. One end of the pushing member passes through an upper end of the atomizing cover. The pushing member is made of a hard material having the ability to absorb cigarette liquid. When the sealing member is in the second state, the pushing member replaces the sealing member to seal the liquid outlet opening and the liquid storage chamber communicates with the atomizing chamber via the pushing member.

Further, the atomizing assembly further includes an atomizing base disposed at a lower end of the atomizing cover and a first electrode mounted at a lower end of the atomizing base. An air outlet hole is provided at an upper end of the atomizing cover. A first air inlet opening is provided in the atomizing base. A second air inlet opening is provided in the first electrode. When the atomizing assembly and the liquid storage assembly are connected, the second air inlet opening, the first air inlet opening, the atomizing chamber, the air outlet hole and the air outlet passage are communicated sequentially.

Further, the atomizer further includes a base assembly. The base assembly includes a bottom base, an air intake member mounted on the bottom base and an air adjusting member rotatably sleeved on the air intake member. One end of the air intake member opposite to the bottom base is detachably connected to the atomizing base. The air intake member is provided with an air venting groove communicating with the second air inlet opening. The air adjusting member is provided with an air inlet hole corresponding to the air venting groove. When the air adjusting member is rotated to change the overlapping degree of the air inlet hole and the air venting groove, the amount of intaking air is adjusted and controlled.

Further, the atomizing chamber is formed by an inner space of the pushing member. A through hole communicating with the atomizing chamber is provided in the pushing member corresponding to the liquid outlet opening.

Further, an upper end of the pushing member extends upward in the axial direction of the pushing member to form a pushing portion. The through hole is defined in the upper surface of the pushing member. When the pushing portion passes through the liquid outlet opening to abut against the sealing member, the sealing member is in the second state, and the liquid storage chamber communicates with the atomizing chamber through the liquid outlet opening and the through hole.

Further, the atomizing assembly further includes a casing, and the pushing member is fixedly disposed at an upper end of the casing. The atomizing chamber is formed by an inner space of the casing. The upper end of the casing is provided with a liquid inlet hole communicating with the atomizing chamber. When the sealing member is in the second state, the liquid storage chamber communicates with the atomizing chamber through the liquid outlet opening and the liquid inlet hole.

Further, a magnetic attraction portion is provided at one end of the pushing member away from the casing. The magnetic attraction portion and the sealing member are made of magnetic material.

An electronic cigarette including the above atomizer.

The beneficial effects of the present disclosure are: in the atomizer or the electronic cigarette of the present disclosure, when the atomizing assembly and the liquid storage assembly are connected together for use, the pushing member drives the sealing member to move and the liquid outlet opening is opened, so that the cigarette liquid in the liquid storage chamber can pass through the liquid outlet opening to enter the atomizing chamber, and when the atomizing assembly and the liquid storage assembly are separated, the sealing member can be automatically reset under the action of an elastic force or a magnetic force to seal the liquid storage chamber. It effectively avoids the occurrence of children's contact and even ingestion of the cigarette liquid, thereby having a safety protection function.

BRIEF DESCRIPTION OF THE DRAWINGS

The present disclosure will now be further described with reference to the accompanying drawings and embodiments.

Figure 1:
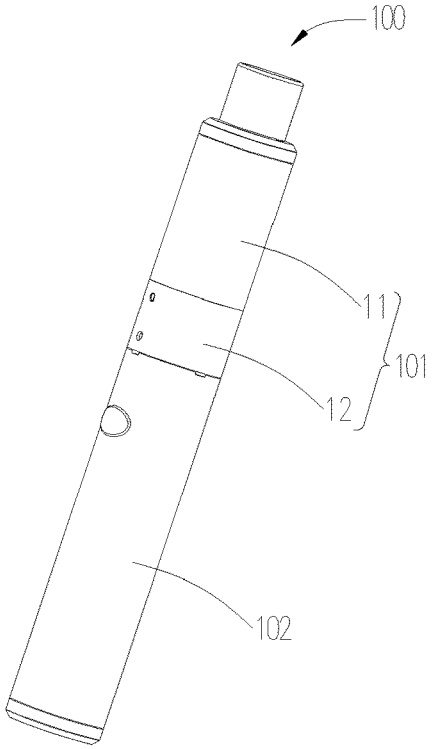
FIG. 1 is a schematic perspective view showing the structure of an electronic cigarette according to a first embodiment of the present disclosure.

The part names and their reference signs in the drawings are:

| | | |
|---|---|---|
| electronic cigarette 100 | atomizer 101 | power supply device 102 |
| liquid storage assembly 11 | atomizing assembly 12 | liquid storage tube 111 |
| top cover 112 | mouthpiece connector 113 | sealing member 114 |
| elastic member 115 | blocking member 116 | outer sleeve 121 |
| atomizing base 122 | pushing member 123 | electrode 124 |
| insulating member 125 | liquid guiding member 126 | heating member 127 |
| liquid storage chamber 1111 | liquid outlet opening 1112 | first positioning step 1113 |
| air outlet passage 1114 | locking groove 1115 | positioning flange 1141 |
| second positioning step 1142 | liquid guiding groove 1143 | liquid injection hole 1144 |
| first air inlet hole 1211 | locking protrusion 1212 | atomizing chamber 1213 |
| connecting tube 1221 | second air inlet hole 1222 | flange 1231 |
| air inlet groove 1232 | mounting hole 1233 | liquid inlet hole 1234 |
| liquid inlet groove 1235 | sealing ring 1145 | |
| atomizer 201 | liquid storage assembly 21 | atomizing assembly 22 |
| base assembly 23 | outer sleeve 211 | top cover 212 |
| bottom cover 213 | liquid storage tube 214 | sealing member 215 |
| elastic member 216 | atomizing base 221 | first electrode 222 |
| first insulating member 223 | atomizing cover 224 | pushing member 225 |
| heating member 226 | bottom base 231 | second electrode 232 |
| second insulating member 233 | air intake member 234 | air adjusting member 235 |
| visible window 2111 | mouthpiece connecting portion 2121 | liquid outlet opening 2131 |
| air outlet groove 2132 | second internal thread 2133 | liquid storage chamber 2141 |
| air outlet passage 2142 | mounting portion 2211 | first air inlet opening 2212 |

-continued

| | | |
|---|---|---|
| first external thread 2213 | second air inlet opening 2221 | atomizing chamber 2241 |
| through hole 2242 | air outlet hole 2243 | connecting tube 2311 |
| air venting groove 2341 | first internal thread 2342 | second external thread 2343 |
| air inlet hole 2351 | | |
| liquid storage tube 311 | sealing member 312 | elastic member 313 |
| pushing member 321 | liquid storage chamber 3111 | liquid outlet opening 3112 |
| resisting portion 3121 | wedge-shaped surface 3122 | |
| liquid storage tube 411 | sealing member 412 | elastic member 413 |
| pushing member 421 | liquid storage chamber 4111 | liquid outlet opening 4112 |
| electronic cigarette 500 | atomizer 501 | power supply device 502 |
| liquid storage assembly 51 | atomizing assembly 52 | liquid storage tube 511 |
| bottom cover 512 | sealing member 513 | elastic member 514 |
| pressing plate 515 | pushing member 521 | air outlet passage 5111 |
| liquid storage chamber 5112 | liquid outlet opening 5121 | internal thread 5122 |
| liquid guiding groove 5131 | pushing portion 5211 | through hole 5212 |
| external thread 5213 | atomizing chamber 5214 | positioning portion 5123 |
| positioning groove 5132 | first sleeve portion 5133 | second sleeve portion 5134 |
| step surface 5135 | | |
| electronic cigarette 600 | atomizer 601 | power supply device 602 |
| liquid storage assembly 61 | atomizing assembly 62 | liquid storage tube 611 |
| stopper 612 | sealing member 613 | casing 621 |
| liquid guiding and heating structure 623 | pushing member 624 | air outlet passage 6111 |
| liquid storage chamber 6112 | liquid outlet opening 6121 | air inlet hole 6211 |
| liquid inlet hole 6212 | atomizing chamber 6213 | magnetic portion 6241 |

DETAILED DESCRIPTION OF PREFERRED EMBODIMENTS

The present disclosure will now be described in detail in conjunction with the drawings. These drawings are simplified schematic diagrams illustrating the basic structure of the present disclosure only in a schematic manner, and thus they show only the configuration related to the present disclosure.

First Embodiment

Figure 2:
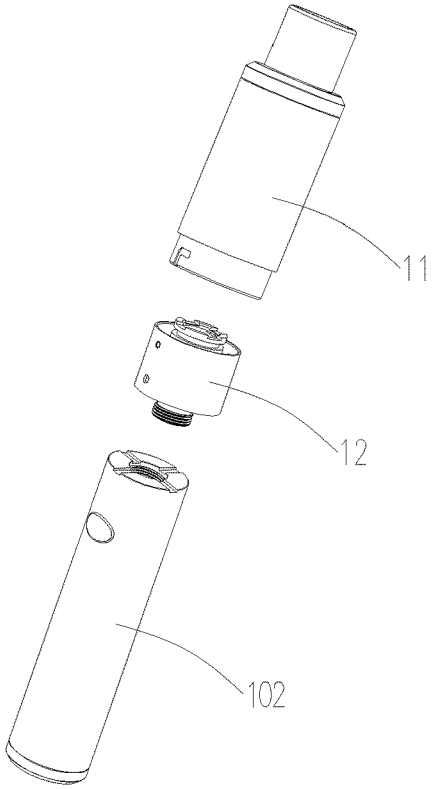
FIG. 2 is a partially exploded view of the electronic cigarette of FIG. 1.

Referring to FIG. 1 and FIG. 2, the first embodiment of the present disclosure provides an electronic cigarette 100 including an atomizer 101 and a power supply device 102 mounted to the atomizer 101. The atomizer 101 includes a liquid storage assembly 11 and an atomizing assembly 12 detachably connected to the lower end of the liquid storage assembly 11. The power supply device 102 is detachably connected to the lower end of the atomizing assembly 12. The cigarette liquid stored in the liquid storage assembly 11 enters into the atomizing assembly 12, and the atomizing assembly 12 atomizes the cigarette liquid into smoke under the driving of the power supply device 102 for being inhaled by the user.

Figure 3:
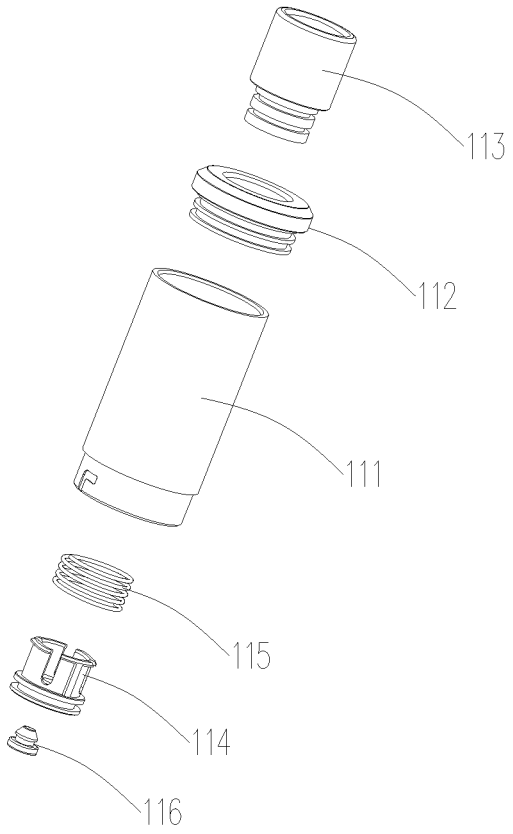
FIG. 3 is an exploded view of the liquid storage assembly of the electronic cigarette shown in FIG. 2.

Referring to FIG. 3, the liquid storage assembly 11 includes a liquid storage tube 111, a top cover 112 mounted to the upper end of the liquid storage tube 111, a mouthpiece connector 113 connected to the top cover 112, a sealing member 114 movably received in the liquid storage tube 111, an elastic member 115 disposed between the liquid storage tube 111 and the sealing member 114, and a blocking member 116 mounted at the lower end of the sealing member 114.

Figure 4:
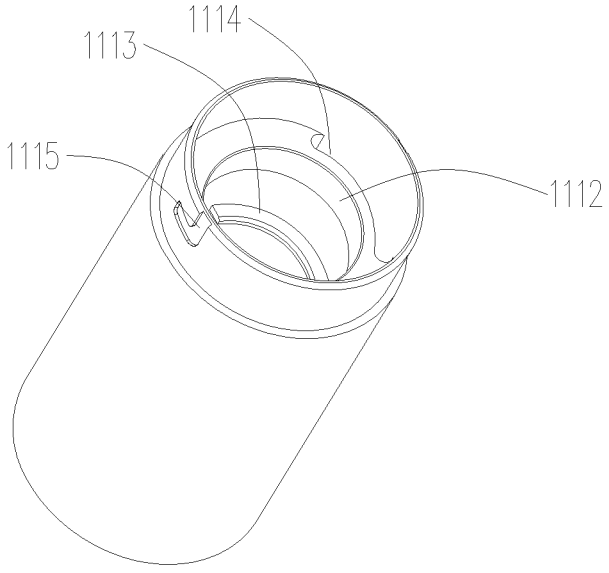
FIG. 4 is a schematic view showing the structure of the liquid storage tube in the liquid storage assembly shown in FIG. 3.
Figure 7:
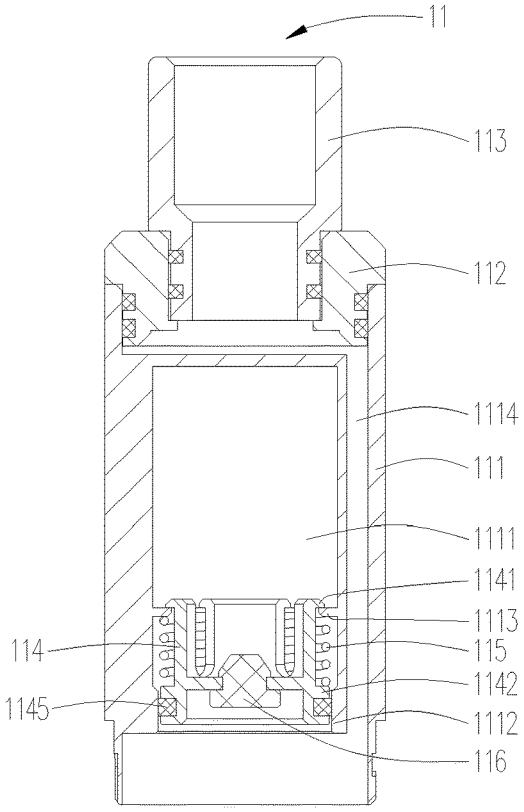
FIG. 7 is a cross-sectional view of the liquid storage assembly of the electronic cigarette shown in FIG. 2 (the liquid storage chamber is sealed)

Referring to FIG. 4 and FIG. 7, the liquid storage tube 111 has a cylindrical hollow structure with an opening at a lower end. The inner space of the liquid storage tube 111 forms a liquid storage chamber 1111 for storing the cigarette liquid, and the opening at the lower end of the liquid storage chamber 1111 forms a liquid outlet opening 1112. The inner wall of the liquid storage chamber 1111 is provided with a first positioning step 1113 at a position above the liquid outlet opening 1112. The side wall of the liquid storage tube 111 is defined with an air outlet passage 1114 located on one side of the liquid storage chamber 1111 and extending through the upper and lower surfaces of the liquid storage tube 111 along an axial direction of the liquid storage tube 111. The air outlet passage 1114 and the liquid storage chamber 1111 are isolated from each other. At least one L-shaped locking groove 1115 is defined in the outer wall of the lower end of the liquid storage tube 111. In this embodiment, the number of the locking groove 1115 is two, and the two locking grooves 1115 are symmetrically disposed.

The top cover 112 has a substantially annular structure. The outer peripheral surface of the lower end of the top cover 112 is connected to the inner peripheral surface of the upper end of the liquid storage tube 111. The mouthpiece connector 113 has a substantially tubular structure, and the outer peripheral surface of the lower end of the mouthpiece connector 113 is connected to the inner peripheral surface of the top cover 112. The mouthpiece connector 113, the top cover 112 and the air outlet passage 1114 are communicated sequentially.

Figure 5:
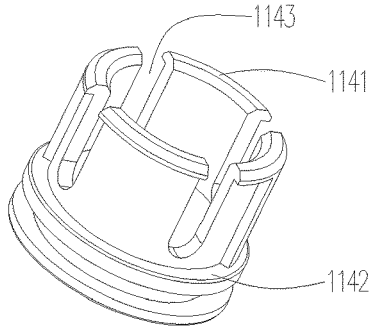
FIG. 5 is a schematic view showing the structure of the sealing member in the liquid storage assembly shown in FIG. 3.

Referring to FIG. 5, the sealing member 114 has a substantially cylindrical structure. The upper end of the sealing member 114 is provided outwardly with a positioning flange 1141 along the circumferential direction of the sealing member 114. The lower end of the sealing member 114 is provided outwardly with a second positioning step 1142 along the circumferential direction of the sealing member 114 for engaging in the liquid outlet opening 1112. At least one liquid guiding groove 1143 communicating with the liquid storage chamber 1111 is defined in the side wall of the sealing member 114. When the sealing member 114 is installed in the liquid storage tube 111, the positioning flange 1141 of the sealing member 114 abuts against the upper surface of the first positioning step 1113 of the liquid storage tube 111 to prevent the sealing member 114 from falling off from the liquid storage tube 111.

Further, in order to facilitate mounting of the sealing member 114, the sealing member 114 is made of elastic plastic material.

Referring to FIG. 7, one end of the elastic member 115 elastically resists the first positioning step 1113, and the other end of the elastic member 115 elastically resists the second positioning step 1142. When the elastic member 115 is in the natural state, since the outer diameter of the second positioning step 1142 is equal to the inner diameter of the liquid outlet opening 1112, the outer circumferential surface of the second positioning step 1142 is fitted with the liquid outlet opening 1112 closely to seal the liquid outlet opening 1112, so that the cigarette liquid in the liquid storage chamber 1111 cannot flow out to the outside of the liquid storage chamber 1111 via the liquid outlet opening 1112.

Further, in order to improve the sealing effect between the second positioning step 1142 and the liquid outlet opening 1112 to prevent liquid leakage, a sealing ring 1145 is disposed between the second positioning step 1142 and the bottom of the sealing member 114.

In the embodiment, the elastic member 115 is a spring sleeved on the sealing member 114. It is understood that the number of the elastic member 115 is not limited. The elastic member 115 may also be multiple. For example, an elastic member 115 is provided at each of two opposite sides of the sealing member 114. The type of the elastic member 115 is also not limited, and may be a member having elasticity and rigidity, such as a thin steel sheet or the like.

Figure 6:
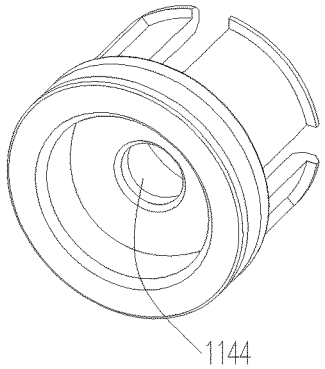
FIG. 6 is another schematic view of the sealing member shown in FIG. 5.

Further, please also refer to FIG. 6, a liquid injection hole 1144 communicating with the liquid storage chamber 1111 is provided at the center portion of the lower end of the sealing member 114, in order to fill the liquid storage chamber 1111 with the cigarette liquid through the liquid injection hole 1144. After the filling is performed, the liquid injection hole 1144 is sealed by installing the blocking member 116.

Figure 8:
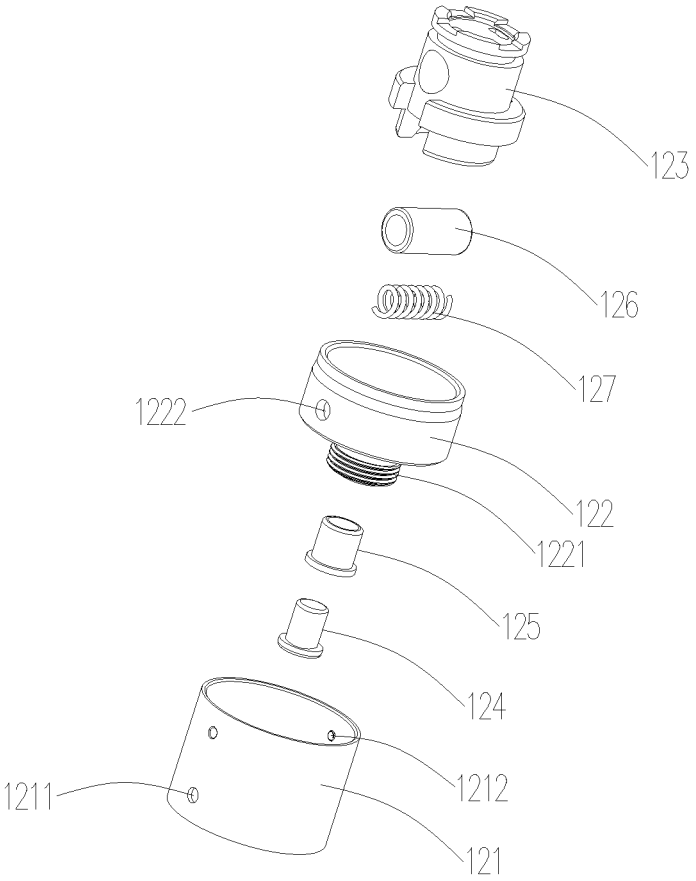
FIG. 8 is an exploded view of the atomizing assembly of the electronic cigarette shown in FIG. 2.
Figure 10:
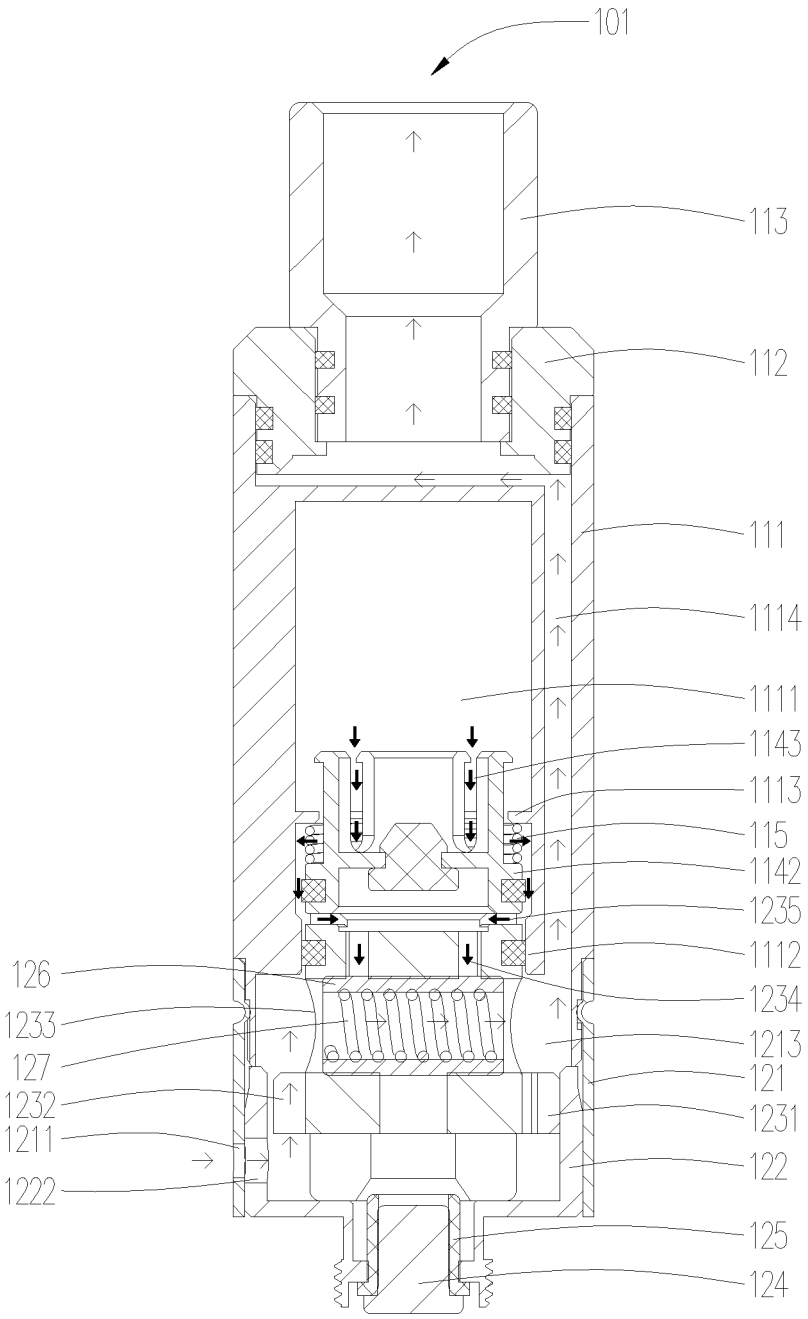
FIG. 10 is a cross-sectional view of the atomizer in the electronic cigarette shown in FIG. 1 (the liquid storage chamber is opened)

Referring to FIG. 8 and FIG. 10, the atomizing assembly 12 includes an outer sleeve 121, an atomizing base 122 received at the lower end of the outer sleeve 121, a pushing member 123 received at the upper end of the outer sleeve 121, an electrode 124 and an insulating member 125 both of which are mounted to the atomizing base 122, and a liquid guiding member 126 and a heating member 127 both of which are mounted to the pushing member 123.

The outer sleeve 121 has a hollow cylindrical structure with openings at both ends. A first air inlet hole 1211 is defined in the side wall of the outer sleeve 121. The inner wall of the outer sleeve 121 is defined with at least one locking protrusion 1212 above the first air inlet hole 1211. Each of the locking protrusions 1212 corresponds to a locking groove 1115. By engaging the locking protrusion 1212 into the locking groove 1115, the outer sleeve 121 is connected to the liquid storage tube 111.

Further, the inner space of the outer sleeve 121 forms an atomizing chamber 1213 for atomizing the cigarette liquid. When the outer sleeve 121 is connected to the liquid storage tube 111, the atomizing chamber 1213 is in communication with the air outlet passage 1114.

The atomizing base 122 has a round cup-like structure and is connected to the lower end of the outer sleeve 121 by an interference fit. The side wall of the atomizing base 122 is provided with a second air inlet hole 1222 corresponding to the first air inlet hole 1211 and communicating with the first air inlet hole 1211. The center portion of the lower end of the atomizing base 122 extends downwardly to form a connecting tube 1221 communicating with the inner space of the atomizing base 122. The electrode 124 is installed in the connecting tube 1221, and the insulating member 125 is sandwiched between the electrode 124 and the connecting tube 1221 for insulation. The lower end of the electrode 124 is electrically connected to a battery (not shown) in the power supply device 102.

Further, the outer wall of the connecting tube 1221 is provided with an external thread to be screwed to the power supply device 102.

Figure 9:
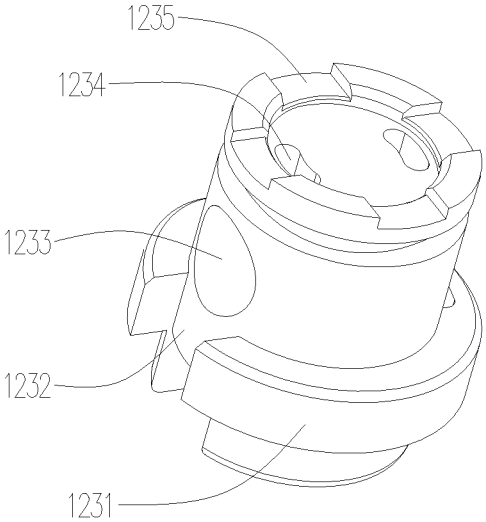
FIG. 9 is a schematic view showing the structure of the pushing member in the atomizing assembly shown in FIG. 8.

Referring also to FIG. 9, the pushing member 123 has a substantially columnar structure. The outer wall of the pushing member 123 is provided with a flange 1231 along the circumferential direction of the pushing member 123. The pushing member 123 is connected to the atomizing base 122 by an interference fit through the flange 1231. The flange 1231 is provided with at least one air inlet groove 1232 communicating with the atomizing chamber 1213. The pushing member 123 is provided with a mounting hole 1233 located above the flange 1231 and extending through two opposite sides of the pushing member 123 along the radial direction of the pushing member 123. The upper surface of the pushing member 123 is provided with at least one liquid inlet hole 1234 communicating with the mounting hole 1233. The side wall of the upper end of the pushing member 123 is provided with a liquid inlet groove 1235 communicating with the liquid inlet hole 1234.

Referring to FIG. 10, when the outer sleeve 121 is connected to the liquid storage tube 111, the upper end of the pushing member 123 is engaged in the liquid outlet opening 1112 of the liquid storage tube 111. Specifically, the pushing member 123 pushes the sealing member 114 to move upwardly and compress the elastic member 115, and the upper end of the pushing member 123 replaces the position of the second positioning step 1142 of the sealing member 114 to seal the liquid outlet opening 1112. At this time, the cigarette liquid in the liquid storage chamber 1111 can enter the liquid inlet hole 1234 via the liquid inlet groove 1235, and finally flows into the mounting hole 1233.

Further, in order to improve the sealing effect between the pushing member 123 and the liquid outlet opening 1112 to prevent liquid leakage, a sealing ring (not labeled) is disposed on the outer wall of the pushing member 123.

The liquid guiding member 126 and the heating member 127 are mounted in the mounting hole 1233. The liquid guiding member 126 is used to absorb the cigarette liquid flowing into the mounting hole 1233 via the liquid inlet hole 1234. The heating member 127 is electrically connected to the upper end of the electrode 124 and used to heat and atomize the cigarette liquid absorbed by the liquid guiding member 126 into smoke.

In this embodiment, the liquid guiding member 126 surrounds the heating member 127. It is understood that the liquid guiding member 126 can also be surrounded by the heating member 127. The liquid guiding member 126 may be cotton, porous ceramic or the like, and the heating member 127 may be a heating wire, a porous heating sheet or the like.

The installation and use process of the atomizer 101 of the present disclosure will be described below with reference to the accompanying drawings.

Referring to FIG. 10, when mounting the atomizing assembly 12 to the liquid storage assembly 11, it is only necessary to push and then rotate the outer sleeve 121, to cause the locking protrusions 1212 to engage in the locking grooves 1115. During this process, the pushing member 123 gradually approaches the sealing member 114. When the pushing member 123 contacts with the sealing member 114 and continues to move, the sealing member 114 is driven by the pushing member 123 to move upwardly and compress the elastic member 15, until the upper end of the pushing member 123 replaces the position of the second positioning step 1142 of the sealing member 114 to seal the liquid outlet opening 1112 of the liquid storage tube 111. At this time, the liquid inlet groove 1235 is communicated with the liquid storage chamber 1111 via the liquid guiding groove 1143, and the cigarette liquid in the liquid storage chamber 1111 enters the mounting hole 1233 sequentially via the liquid guiding groove 1143, the liquid inlet groove 1235 and the liquid inlet hole 1234. After being absorbed by the liquid guiding member 126, the cigarette liquid is atomized into smoke in the atomizing chamber 1213 by heating of the heating member 127. The direction indicated by the thick arrow in FIG. 10 is the flow direction of the cigarette liquid.

When the user inhales, the external air enters the atomizing chamber 1213 through the first air inlet hole 1211, the second air inlet hole 1222 and the air inlet groove 1232, and then mixes with the smoke. The mixed gas sequentially passes through the air outlet passage 1114, the top cover 112 and the mouthpiece connector 113, and is finally fed into the user's mouth. The direction indicated by the thin arrow in FIG. 10 is the flow direction of the airflow.

When the atomizing assembly 12 is separated from the liquid storage assembly 11, it is only necessary to rotate and then withdraw the outer sleeve 121 away from the liquid storage tube 111, so that the locking protrusions 1212 are disengaged from the locking grooves 1115. Referring to FIG. 7, during the process of the pushing member 123 gradually moving away from the liquid storage tube 111, the sealing member 114 moves downward under the restoring action of the elastic member 115 until the sealing member 114 seals the liquid outlet opening 1112 again. At this time, the liquid guiding groove 1143 is not in communication with the liquid inlet groove 1235, so that the cigarette liquid in the liquid storage chamber 1111 is sealed and the cigarette liquid cannot flow out, as shown in the state of FIG. 7.

It is understood that the first positioning step 1113 can be omitted. At this time, one end of the elastic member 115 elastically resists the second positioning step 1142 or the positioning flange 1141, and the other end of the elastic member 115 elastically resists the top wall of the liquid storage chamber 1111, to achieve the same technical effect.

It is understood that the liquid inlet hole 1234 can be omitted. At this time, the liquid inlet groove 1235 is defined also though the side wall of the pushing member 123 to directly communicate with the mounting hole 1233, and the cigarette liquid is directly guided by the liquid inlet groove 1235 to be absorbed by the liquid guiding member 126 mounted in the mounting hole 1233.

In this embodiment, the outer sleeve 121 and the liquid storage tube 111 are detachably connected by clamping. It is understood that the outer sleeve 121 and the liquid storage tube 111 can also be connected by screwing or magnetic connection, etc., so that the detachable connection between the liquid storage assembly 11 and the atomizing assembly 12 is also realized.

In the atomizer 101 provided by the first embodiment of the present disclosure, when the atomizing assembly 12 is separated from the liquid storage assembly 11, the sealing member 114 can automatically seal the liquid storage chamber 1111 under the restoring action of the elastic member 115. The cigarette liquid in the liquid storage chamber 1111 cannot flow out even if the atomizer 101 is opened by the children, to prevent the children from contact or even ingestion of the cigarette liquid, thereby having an effective child protection function.

The first embodiment of the present disclosure further provides an electronic cigarette 100 having the atomizer 101 described above. The electronic cigarette 100 has all the technical features of the atomizer 101, and thus has the same technical effects as the atomizer 101.

Second Embodiment

Figure 11:
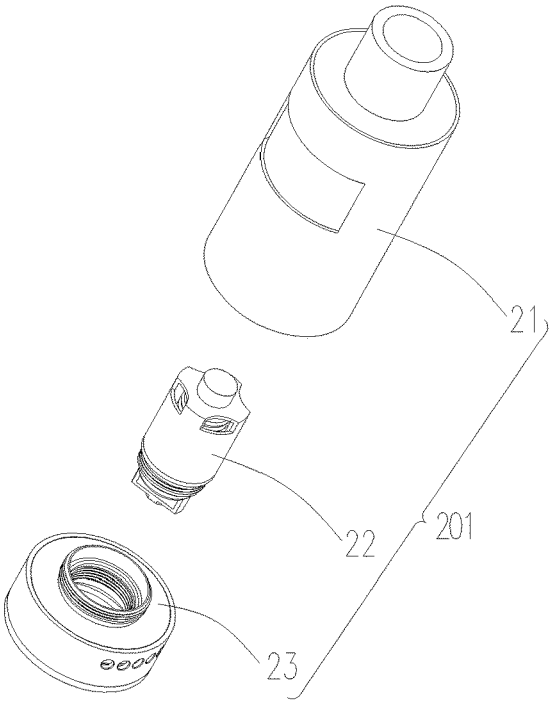
FIG. 11 is a partially exploded view of an atomizer according to a second embodiment of the present disclosure.

Referring to FIG. 11, the second embodiment of the present disclosure provides an electronic cigarette including an atomizer 201 and a power supply device (not shown) connected to the atomizer 201. The atomizer 201 includes a liquid storage assembly 21, an atomizing assembly 22 detachably connected to the lower end of the liquid storage assembly 21, and a base assembly 23 connected to the lower end of the atomizing assembly 22. The power supply device is screwed to the lower end of the base assembly 23.

Figure 12:
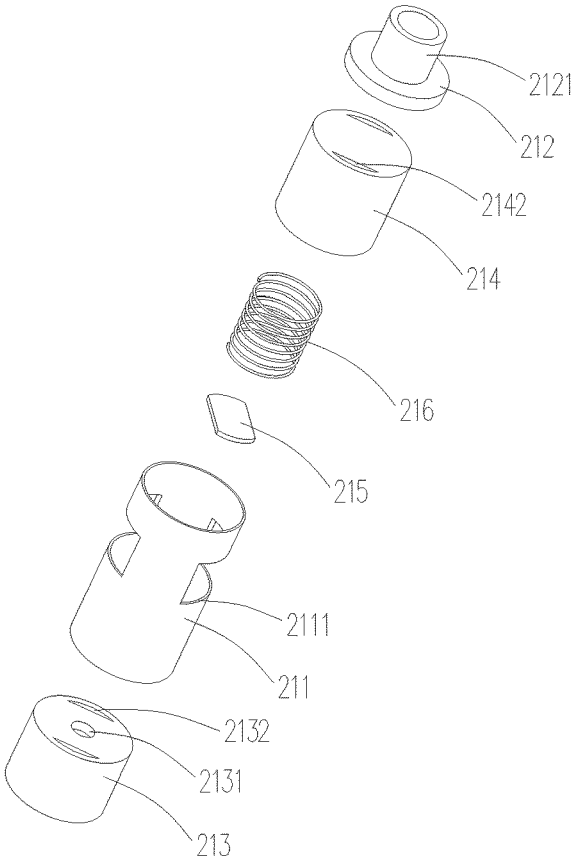
FIG. 12 is an exploded view of the liquid storage assembly of the atomizer of FIG. 11.
Figure 13:
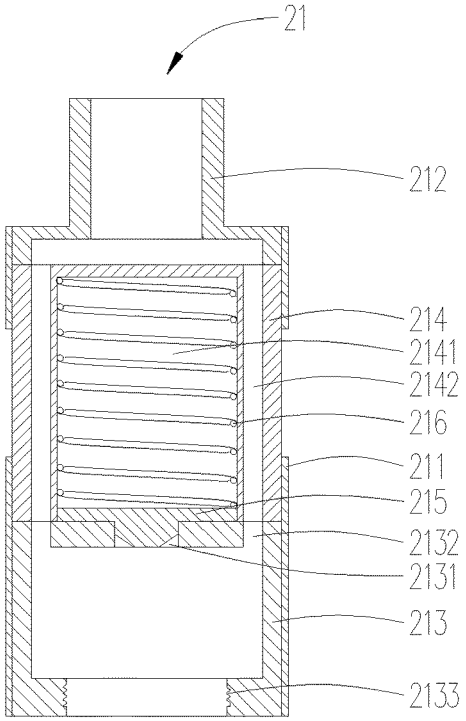
FIG. 13 is a cross-sectional view of the liquid storage assembly of the atomizer shown in FIG. 11 (the liquid storage chamber is sealed)

Referring to FIG. 12 and FIG. 13, the liquid storage assembly 21 includes an outer sleeve 211, a top cover 212 fixedly mounted on the upper end of the outer sleeve 211, a bottom cover 213 fixedly mounted on the lower end of the outer sleeve 211, a liquid storage tube 214 received in the outer sleeve 211 and fixed between the top cover 212 and the bottom cover 213, a sealing member 215 movably received in the liquid storage tube 214, and an elastic member 216 disposed between the liquid storage tube 214 and the sealing member 215.

The outer sleeve 211 has a tubular structure with openings at both ends, and at least one visible window 2111 is defined in the side wall of the outer sleeve 211 to facilitate the user to observe the amount of the cigarette liquid.

The top cover 212 has a substantially annular structure. The top cover 212 is connected to the outer sleeve 211 by an interference fit. The center portion of the top cover 212 extends upward in the axial direction of the top cover 212 to form a mouthpiece connecting portion 2121 communicating with the inner space of the top cover 212. The user can suck through the mouthpiece connecting portion 2121. It is understood that the user can also suck through a cigarette holder mounted to the mouthpiece connecting portion 2121.

The bottom cover 213 has a cylindrical structure with an opening at the lower end. The bottom cover 213 is connected to the outer sleeve 211 by an interference fit. The center portion of the upper surface of the bottom cover 213 is defined with a liquid outlet opening 2131. The upper surface of the bottom cover 213 is defined with two oppositely disposed air outlet grooves 2132 communicating with the inner space of the bottom cover 213 and surrounding the liquid outlet opening 2131.

Further, the lower end of the bottom cover 213 is provided with a second internal thread 2133.

The liquid storage tube 214 has a cylindrical hollow structure with an opening at the lower end. Both ends of the liquid storage tube 214 abut against the lower surface of the top cover 212 and the upper surface of the bottom cover 213, respectively. The inner space of the liquid storage tube 214 forms a liquid storage chamber 2141 for storing the cigarette liquid. Two air outlet passages 2142 corresponding to the two air outlet grooves 2132 are defined in the side wall of the liquid storage tube 214 by extending through the upper and lower surfaces of the liquid storage tube 214 along the axial direction of the liquid storage tube 214. Each air outlet passage 2142 communicates with a corresponding air outlet groove 2132 and the inner space of the top cover 212. The air outlet passages 2142 are isolated from the liquid storage chamber 2141. The upper surface of the bottom cover 213 seals the opening of the liquid storage chamber 2141, and the liquid outlet opening 2131 is in communication with the liquid storage chamber 2141.

The sealing member 215 has an oval-shaped and plate-like structure. One end of the elastic member 216 elastically abuts against the sealing member 215, and the other end of the elastic member 216 elastically abuts against the top wall of the liquid storage tube 214. In the natural state, the sealing member 215 abuts against the upper surface of the bottom cover 213 closely under the elastic action of the elastic member 216 to seal the liquid outlet opening 2131, and the cigarette liquid in the liquid storage chamber 2141 cannot flow out.

Further, in this embodiment, the sealing member 215 is made of a rubber material, and the elastic member 216 is a spring. It is understood that the types of the sealing member 215 and the elastic member 216 are not limited. The sealing member 215 can also be made of plastic, metal or the like to improve the sealing property. The elastic member 216 can also be a member having elasticity and rigidity, such as a thin steel sheet or the like.

Figure 14:
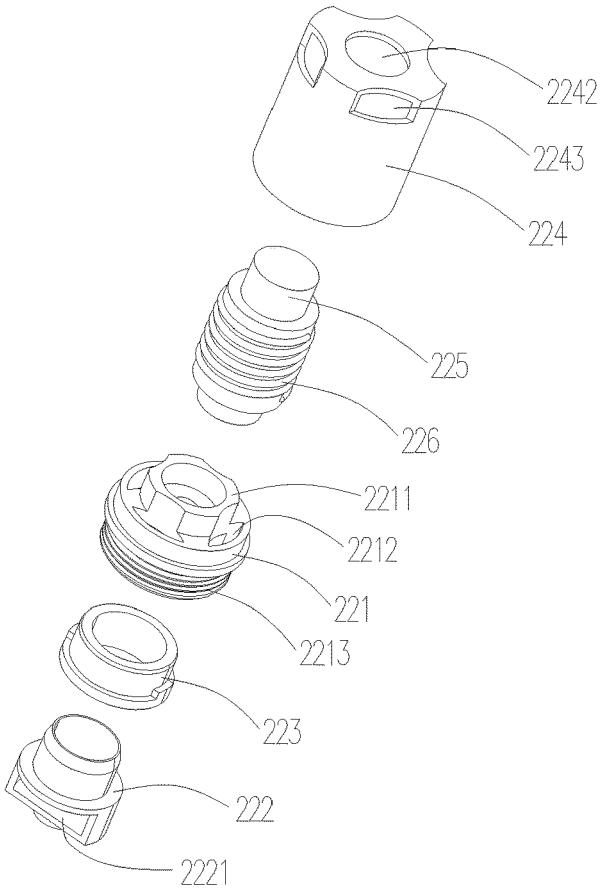
FIG. 14 is an exploded view of the atomizing assembly of the atomizer of FIG. 11.
Figure 15:
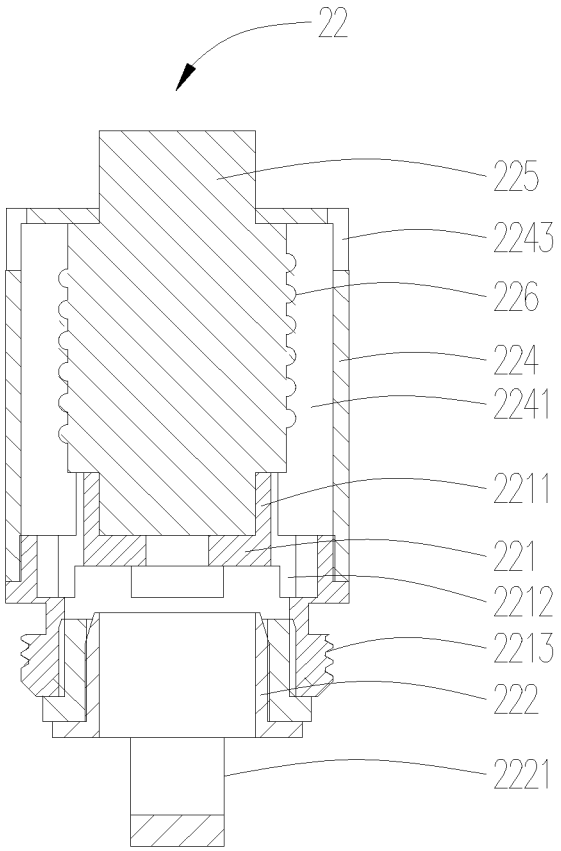
FIG. 15 is a cross-sectional view of the atomizing assembly of the atomizer of FIG. 11.

Referring also to FIG. 14 and FIG. 15, the atomizing assembly 22 includes an atomizing base 221, a first electrode 222 and a first insulating member 223 both of which are mounted at the lower end of the atomizing base 221, an atomizing cover 224 mounted at the upper end of the atomizing base 221, and a pushing member 225 and a heating member 226 both of which are received in the atomizing cover 224.

The atomizing base 221 has a substantially annular structure. The center portion of the upper surface of the atomizing base 221 extends along the axial direction of the atomizing base 221 to form an annular mounting portion 2211. At least one first air inlet opening 2212 communicating with the inner space of the atomizing base 221 is defined in the upper surface of the atomizing base 221 around the mounting portion 2211. The lower end of the atomizing base 221 is provided with a first external thread 2213.

The first electrode 222 has a substantially hollow columnar structure. The first electrode 222 is in communication with the atomizing base 221, and the first electrode 222 is provided with a second air inlet opening 2221 communicating with the first air inlet opening 2212.

Further, the first insulating member 223 is disposed between the atomizing base 221 and the first electrode 222 to provide insulation.

The atomizing cover 224 has a hollow cylindrical structure with an opening at the lower end. The inner space of the atomizing cover 224 forms an atomizing chamber 2241. The center portion of the upper surface of the atomizing cover 224 is provided with a through hole 2242 corresponding to the liquid outlet opening 2131. An air outlet hole 2243 communicating with the atomizing chamber 2241 is defined in the side wall of the upper end of the atomizing cover 224.

The pushing member 225 has a cylindrical structure, and an outer peripheral surface of the lower end of the pushing member 225 is connected to an inner peripheral surface of the mounting portion 2211. The upper end of the pushing member 225 corresponds to the through hole 2242. When the atomizing cover 224 is mounted on the atomizing base 221, the upper end of the pushing member 225 extends through the through hole 2242.

Further, in this embodiment, the pushing member 225 is made of a hard material having the ability to absorb the cigarette liquid, such as a porous ceramic or the like.

In this embodiment, the heating member 226 is coated on the pushing member 225 for heating the cigarette liquid to achieve atomization, and the heating member 226 is electrically connected to the upper end of the first electrode 222. It is understood that the heating member 226 can also be received in the pushing member 225.

Further, the heating member 226 in this embodiment is a heating wire.

Figure 16:
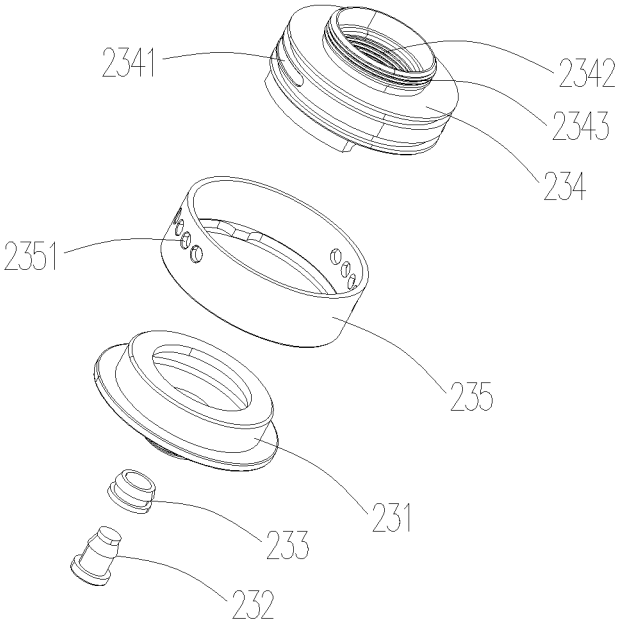
FIG. 16 is an exploded view of the base assembly of the atomizer of FIG. 11.
Figure 17:
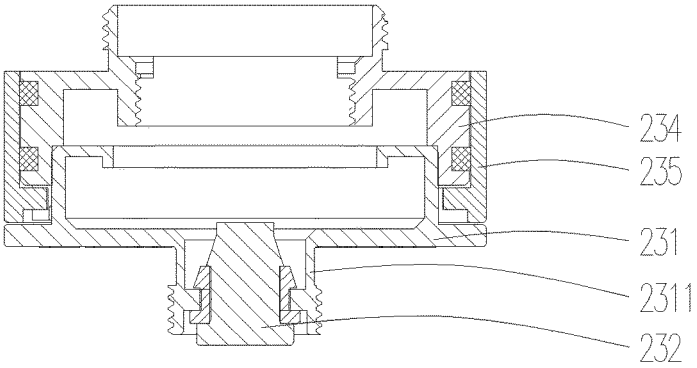
FIG. 17 is a cross-sectional view of the base assembly of the atomizer of FIG. 11.

Referring to FIG. 16 and FIG. 17, the base assembly 23 includes a bottom base 231, a second electrode 232 and a second insulating member 233 both of which are mounted at the lower end of the bottom base 231, an air intake member 234 mounted on the upper end of the bottom base 231, and an air adjusting member 235 rotatably sleeved on the air intake member 234.

The bottom base 231 has a substantially cup-shaped structure. The center portion of the lower end of the bottom base 231 extends downward along the axial direction of the bottom base 231 to form a connecting tube 2311 communicating with the inner space of the bottom base 231. The connecting tube 2311 is provided with a thread for connection with the power supply device.

The second electrode 232 is disposed in the connecting tube 2311. The lower end of the second electrode 232 is electrically connected to a battery (not shown) of the power supply device, and the upper end of the second electrode 232 is electrically connected to the lower end of the first electrode 222.

Further, the second insulating member 233 is disposed between the connecting tube 2311 and the second electrode 232 to provide insulation.

The air intake member 234 has a substantially annular structure. The side wall of the air intake member 234 is provided with at least one air venting groove 2341 communicating with the second air inlet opening 2221. The inner wall of the air intake member 234 is provided with a first internal thread 2342 matching with the first external thread 2213 of the atomizing base 221. The first external thread 2213 and the first internal thread 2342 are screwed to realize the connection between the atomizing assembly 22 and the base assembly 23.

Further, the outer wall of the air intake member 234 is provided with a second external thread 2343 matching with the second internal thread 2133 of the bottom cover 213. The second external thread 2343 and the second internal thread 2133 are screwed to realize the connection between the atomizing assembly 22 and the liquid storage assembly 21.

The air adjusting member 235 has an annular structure, and at least one air inlet hole 2351 is defined in the side wall of the air adjusting member 235 corresponding to the air venting groove 2341. When the air adjusting member 235 is rotated to change the overlapping degree of the air inlet hole 2351 and the air venting groove 2341, the amount of intaking air is adjusted and controlled.

Further, a sealing ring (not labeled) may be provided between the air intake member 234 and the air adjusting member 235 to improve airtightness, and meanwhile, the air adjusting feel is enhanced to improve the user experience.

The installation and use process of the atomizer 201 of the present disclosure will be described below with reference to the accompanying drawings.

Figure 18:
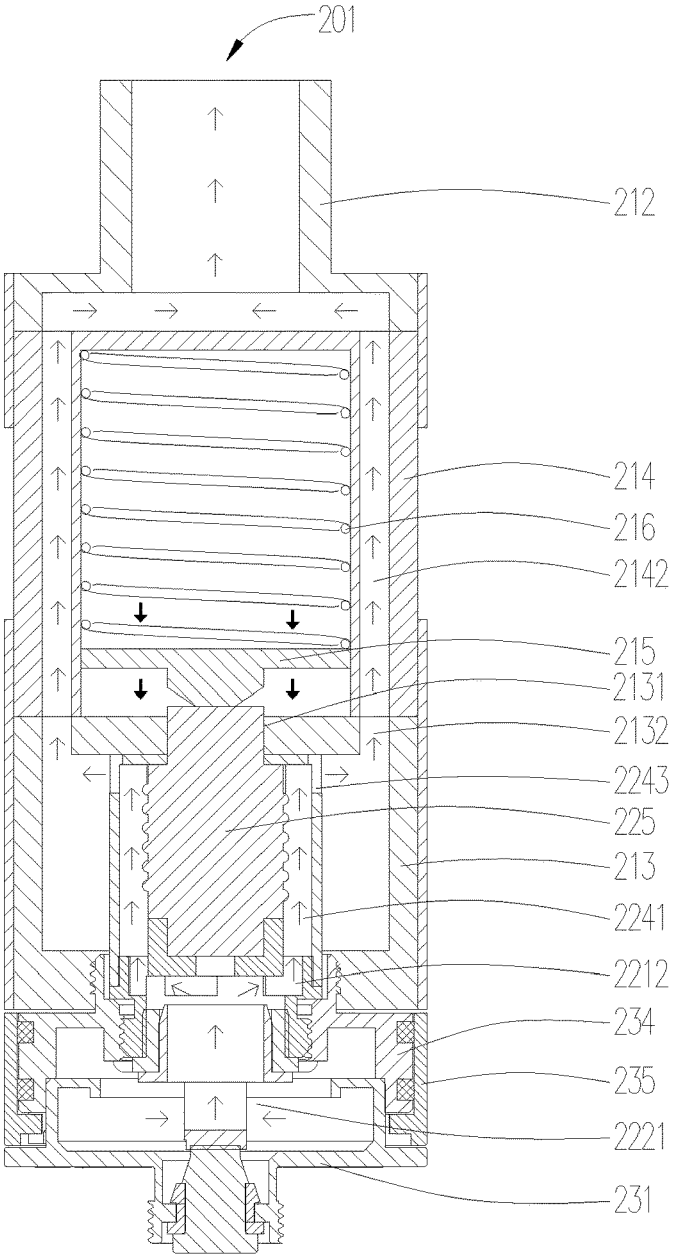
FIG. 18 is a cross-sectional view of the atomizer of FIG. 11 (the liquid storage chamber is opened)

Referring also to FIG. 18, the atomizing assembly 22 is connected to the base assembly 23 by screwing the first external thread 2213 and the first internal thread 2342 together. The base assembly 23 is connected to the liquid storage assembly 21 by screwing the second external thread 2343 and the second internal thread 2133 together. During the screwing process between the base assembly 23 and the liquid storage assembly 21, the pushing member 225 gradually approaches the sealing member 215. When the pushing member 225 continues to move up after contacting the sealing member 215, the sealing member 215 is driven by the pushing member 225 to move upwardly and compress the elastic member 216, so that the sealing member 215 is separated from the upper surface of the bottom cover 213, the liquid outlet opening 2131 is opened, and the cigarette liquid in the liquid storage chamber 2141 flows through the sealing member 215 to be absorbed by the pushing member 225. The absorbed cigarette liquid is atomized into smoke in the atomizing chamber 2241 under heating of the heating member 226 for being inhaled by the user. The direction indicated by the thick arrow in FIG. 18 is the flow direction of the cigarette liquid.

In use, the external air enters the atomizing chamber 2241 to mix with the smoke through the air inlet hole 2351, the air venting groove 2341, the second air inlet opening 2221 and the first air inlet opening 2212. The mixed smoke flows out sequentially through the air outlet hole 2243, the air outlet groove 2132 and the air outlet passage 2142 to enter the top cover 212, and is then fed into the user's mouth. The direction indicated by the thin arrow in FIG. 18 is the flow direction of the airflow.

When the atomizing assembly 22 is detached and separated from the liquid storage assembly 21, the pushing member 225 is moved gradually downward, and the sealing member 215 is driven to move gradually downward under the restoring action of the elastic member 216. When the pushing member 225 is completely separated from the sealing member 215, the sealing member 215 closely abuts on the upper surface of the bottom cover 213 due to the elastic force of the elastic member 216, thereby sealing the liquid outlet opening 2131, and the cigarette liquid in the liquid storage chamber 2141 cannot flow out, as shown in the state of FIG. 13.

In the atomizer 201 provided by the second embodiment of the present disclosure, when the atomizing assembly 22 is separated from the liquid storage assembly 21, the sealing member 215 can automatically seal the liquid storage chamber 2141 under the restoring action of the elastic member 216. The cigarette liquid in the liquid storage chamber 2141 cannot flow out even if the atomizer 201 is opened by the children, to prevent the children from contact or even ingestion of the cigarette liquid, thereby having an effective child protection function.

The second embodiment of the present disclosure further provides an electronic cigarette (not shown) having the atomizer 201. The electronic cigarette has all the technical features of the atomizer 201, and thus has the same technical effects as the atomizer 201.

Third Embodiment

The third embodiment of the present disclosure provides an atomizer including a liquid storage assembly and an atomizing assembly detachably connected to the liquid storage assembly. The liquid storage assembly and the atomizing assembly are connected together by threads, clamping or magnetic connection.

Figure 19:
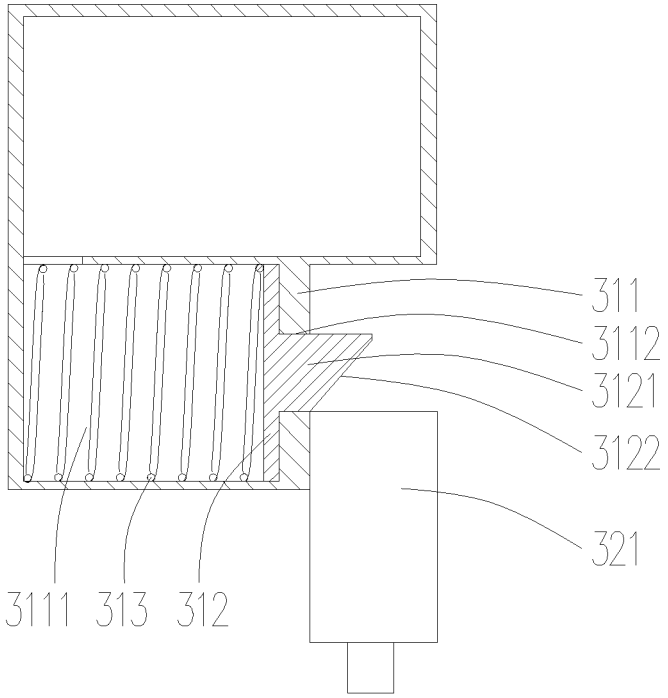
FIG. 19 is a partial schematic view showing the structure of an atomizer according to a third embodiment of the present disclosure (the liquid storage chamber is sealed)

Referring to FIG. 19, the liquid storage assembly includes a liquid storage tube 311, a sealing member 312 movably received in the liquid storage tube 311, and an elastic member 313 received in the liquid storage tube 311 and disposed between the liquid storage tube 311 and the sealing member 312.

The inner space of the liquid storage tube 311 forms a liquid storage chamber 3111 for storing the cigarette liquid, and a liquid outlet opening 3112 communicating with the liquid storage chamber 3111 is defined in the side wall of the liquid storage tube 311.

The sealing member 312 has a plate-like structure and is vertically disposed in the liquid storage tube 311. A resisting portion 3121 is provided on the side wall of the sealing member 312 and extends away from the elastic member 313. The resisting portion 3121 can extend out from the liquid outlet opening 3112. One end of the resisting portion 3121 away from the elastic member 313 is provided with a wedge-shaped surface 3122 facing downward.

One end of the elastic member 313 elastically abuts against the side wall of the liquid storage tube 311, and the other end of the elastic member 313 elastically abuts against the sealing member 312 at the side opposite from the resisting portion 3121. When the elastic member 313 is in the natural state, the side wall of the sealing member 312 away from the elastic member 313 closely abuts against the side wall of the liquid storage tube 311 under the elastic force of the elastic member 313. At this time, the sealing member 312 seals the liquid outlet opening 3112 and the cigarette liquid cannot flow out.

The atomizing assembly includes a pushing member 321 and a liquid guiding member (not shown) and a heating member (not shown) which are received in the pushing member 321.

The pushing member 321 is disposed at one side of the liquid storage tube 311 and contacts with the liquid storage tube 311. An atomizing chamber (not shown) is provided inside the pushing member 321, with the liquid guiding member and the heating member being disposed in the atomizing chamber. A through hole (not shown) communicating with the atomizing chamber is provided in the side wall of the pushing member 321 corresponding to the liquid outlet opening 3112, the liquid guiding member is disposed corresponding to the through hole, and the heating member is disposed close to the liquid guiding member, so that the cigarette liquid flowing into the atomizing chamber of the pushing member 321 from the through hole is absorbed by the liquid guiding member and atomized into smoke by the heating member.

Figure 20:
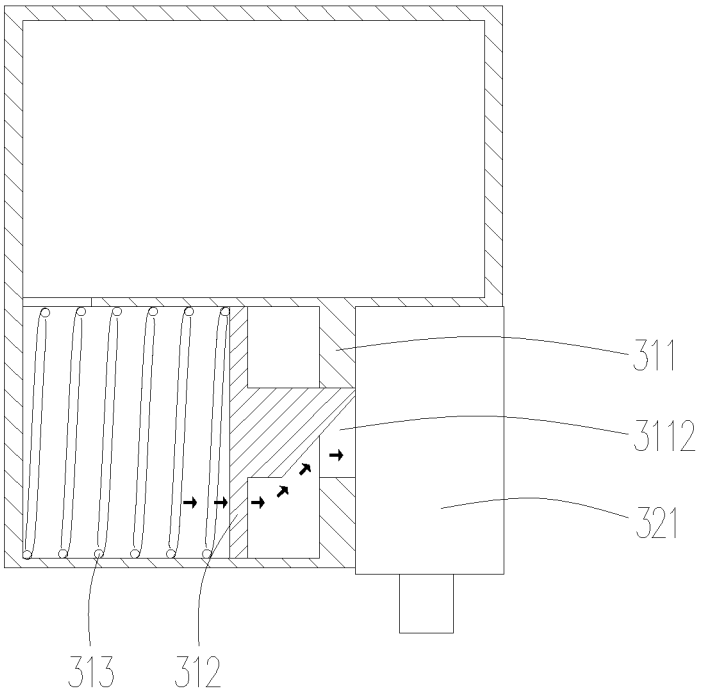
FIG. 20 is another schematic view of the atomizer shown in FIG. 19 (the liquid storage chamber is opened)

Referring to FIG. 20, during the installation of the liquid storage assembly and the atomizing assembly, the pushing member 321 is moved upward along the outer wall of the liquid storage tube 311, and the upper end of the pushing member 321 engages the wedge-shaped surface 3122 of the resisting portion 3121 of the sealing member 312. As the pushing member 321 is moved upward, the sealing member 312 is driven by the pushing member 321 to move in a direction perpendicular to the moving direction of the pushing member 321 to compress the elastic member 313, so that the sealing member 312 is separated from the liquid storage tube 311 and the liquid outlet opening 3112 is opened. The cigarette liquid in the liquid storage chamber 3111 passes through the sealing member 312 and is absorbed by the liquid guiding member via the liquid outlet opening 3112 and the through hole to be atomized into smoke by the heating member. The direction indicated by the arrow in FIG. 20 is the flow direction of the cigarette liquid.

When the atomizing assembly is separated from the liquid storage assembly, the pushing member 321 is moved downward to disengage from the resisting portion 3121, and the elastic member 313 is reset, so that the sealing member 312 moves to finally seal the liquid outlet opening 3112, and the cigarette liquid in the liquid storage chamber 3111 cannot flow out, as shown in the state of FIG. 19.

In the atomizer provided by the third embodiment of the present disclosure, when the liquid storage assembly and the atomizing assembly are separated, the sealing member 312 can automatically seal the liquid storage chamber 3111 under the restoring action of the elastic member 313. Even if the atomizer is opened by the children, it is prevented from contact or even ingestion of the cigarette liquid, thereby having an effective child protection function.

The third embodiment of the present disclosure further provides an electronic cigarette which includes the atomizer and a power supply device (not shown). Since the electronic cigarette has all the technical features of the atomizer, it has the same technical effects as the atomizer.

Fourth Embodiment

The fourth embodiment of the present disclosure provides an atomizer including a liquid storage assembly and an atomizing assembly detachably connected to the liquid storage assembly. The liquid storage assembly and the atomizing assembly are connected together by threads, clamping or magnetic connection.

Figure 21:
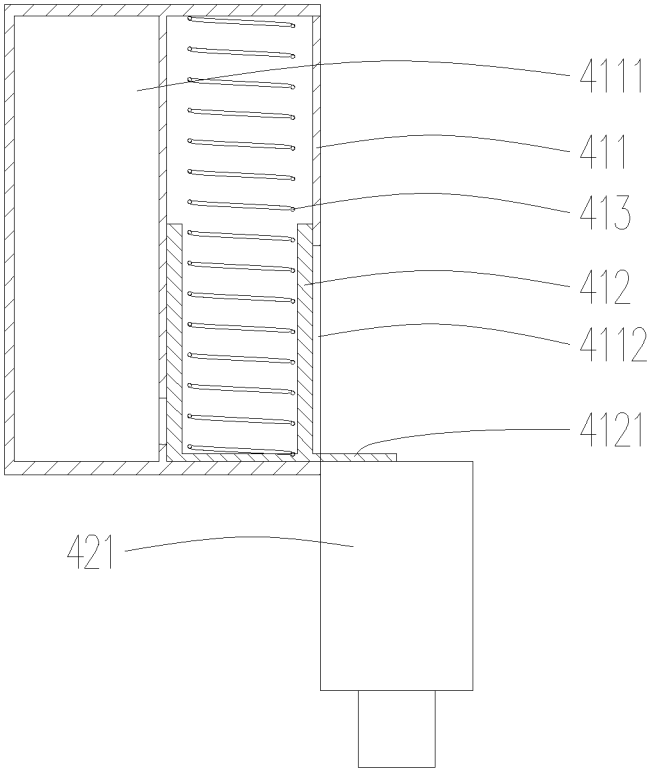
FIG. 21 is a partial schematic view showing the structure of an atomizer according to a fourth embodiment of the present disclosure (the liquid storage chamber is sealed)

Referring to FIG. 21, the liquid storage assembly includes a liquid storage tube 411, a sealing member 412 movably received in the liquid storage tube 411, and an elastic member 413 received in the liquid storage tube 411 and disposed between the liquid storage tube 411 and the sealing member 412.

The inner space of the liquid storage tube 411 forms a liquid storage chamber 4111 for storing the cigarette liquid, and a liquid outlet opening 4112 communicating with the liquid storage chamber 4111 is defined in the side wall of the liquid storage tube 411.

The sealing member 412 has a substantially U-shaped cross-section. A side wall of the sealing member 412 corresponding to the liquid outlet opening 411 is closely attached to the inner wall of the liquid storage tube 411. The side wall of the sealing member 412 is provided with a resisting portion 4121 which extends out from the liquid outlet opening 4112 and can move in the liquid outlet opening 4112 upward and downward.

One end of the elastic member 413 elastically abuts against the top wall of the liquid storage tube 411, and the other end of the elastic member 413 elastically abuts against the bottom wall of the sealing member 412. When the elastic member 413 is in the natural state, the bottom wall of the sealing member 412 closely abuts against the bottom wall of the liquid storage tube 411 under the elastic force of the sealing member 412. At this time, the side wall of the sealing member 412 seals the liquid outlet opening 4112 and the cigarette liquid cannot flow out.

The atomizing assembly includes a pushing member 421 and a liquid guiding member (not shown) and a heating member (not shown) which are received in the pushing member 421.

Figure 22:
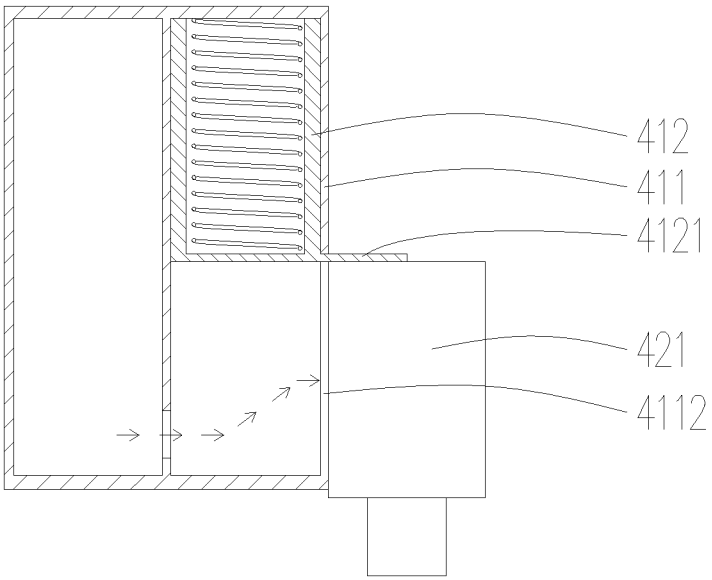
FIG. 22 is another schematic view of the atomizer shown in FIG. 21 (the liquid storage chamber is opened)

The pushing member 421 is disposed at one side of the liquid storage tube 411 and contacts with the liquid storage tube 411. An atomizing chamber (not shown) is provided inside the pushing member 421, with the liquid guiding member and the heating member being disposed in the atomizing chamber. A through hole (not shown) communicating with the atomizing chamber is provided in the side wall of the pushing member 421 corresponding to the liquid outlet opening 4112, the liquid guiding member is disposed corresponding to the through hole, and the heating member is disposed close to the liquid guiding member, so that the cigarette liquid flowing into the atomizing chamber of the pushing member 421 from the through hole is absorbed by the liquid guiding member and atomized into smoke by the heating member Referring to FIG. 22, during the installation of the liquid storage assembly and the atomizing assembly, the pushing member 421 is moved upward along the outer wall of the liquid storage tube 411, and the upper end of the pushing member 421 engages the resisting portion 4121 of the sealing member 412. The sealing member 412 is driven by the pushing member 421 to move along the moving direction of the pushing member 421 to compress the elastic member 413. As the sealing member 412 moves, the liquid outlet opening 4112 is gradually opened. The cigarette liquid in the liquid storage chamber 4111 passes through the liquid outlet opening 4112 and the through hole to be absorbed by the liquid guiding member, and is atomized into smoke by the heating member. The direction indicated by the arrow in FIG. 22 is the flow direction of the cigarette liquid.

When the atomizing assembly is separated from the liquid storage assembly, the pushing member 421 is moved downward and the elastic member 413 is reset, so that the sealing member 412 moves downward until the side wall of the sealing member 412 seals the liquid outlet opening 4112, and the cigarette liquid in the liquid storage chamber 4111 cannot flow out, as shown in the state of FIG. 21.

In the atomizer provided by the fourth embodiment of the present disclosure, when the liquid storage assembly and the atomizing assembly are separated, the sealing member 412 can automatically seal the liquid storage chamber 4111 under the restoring action of the elastic member 413. Even if the atomizer is opened by the children, it is prevented from contact or even ingestion of the cigarette liquid, thereby having an effective child protection function.

The fourth embodiment of the present disclosure further provides an electronic cigarette which includes the atomizer and a power supply device (not shown). Since the electronic cigarette has all the technical features of the atomizer, it has the same technical effects as the atomizer.

Fifth Embodiment

Referring to FIG. 23 to FIG. 26, the fifth embodiment of the present disclosure provides an electronic cigarette 500. The electronic cigarette 500 includes an atomizer 501 and a power supply device 502 connected to the atomizer 501. The atomizer 501 includes a liquid storage assembly 51 and an atomizing assembly 52 detachably connected to the lower end of the liquid storage assembly 51. The power supply device 502 is connected to the lower end of the atomizing assembly 52.

Figure 23:
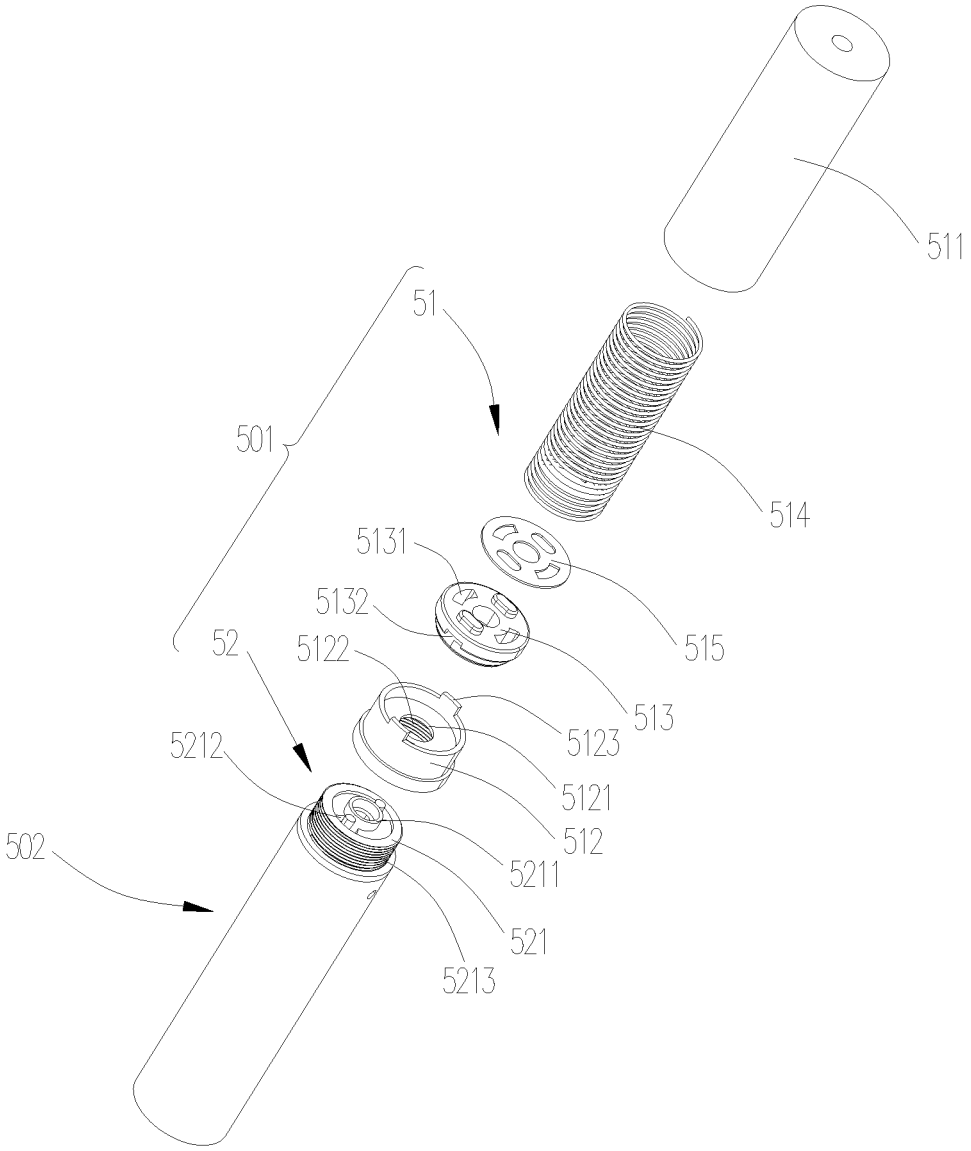
FIG. 23 is a partially exploded view of an electronic cigarette according to a fifth embodiment of the present disclosure.
Figure 25:
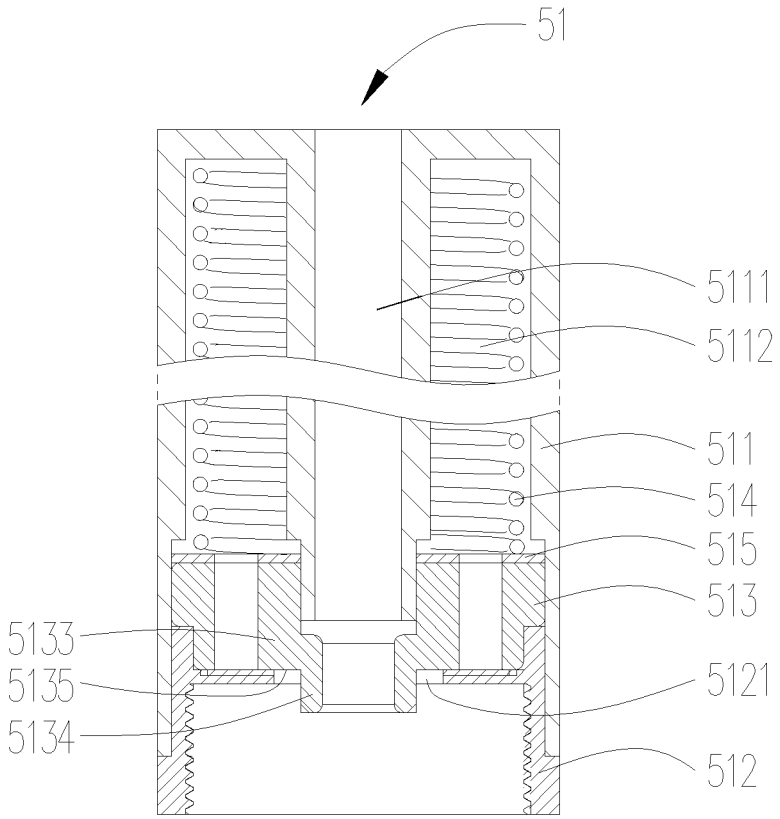
FIG. 25 is a cross-sectional view of the liquid storage assembly of the electronic cigarette shown in FIG. 23 (the liquid storage chamber is sealed)

Referring simultaneously to FIG. 23 and FIG. 25, the liquid storage assembly 51 includes a liquid storage tube 511, a bottom cover 512 fixedly mounted at the lower end of the liquid storage tube 511, a sealing member 513 movably received in the liquid storage tube 511, and an elastic member 514 received in the liquid storage tube 511 and disposed between the liquid storage tube 511 and the sealing member 513.

The liquid storage tube 511 has a tubular hollow structure with an opening at the lower end. The inside of the liquid storage tube 511 is provided with a tubular air outlet passage 5111 extending through the liquid storage tube 511 along the axial direction of the liquid storage tube 511. The space between the outer wall of the air outlet passage 5111 and the inner wall of the liquid storage tube 511 forms a liquid storage chamber 5112 for storing the cigarette liquid.

The bottom cover 512 has a cylindrical structure. The center portion of the upper surface of the bottom cover 512 is provided with a liquid outlet opening 5121 capable of communicating with the liquid storage chamber 5112.

Further, an inner thread 5122 is provided on the inner wall of the bottom cover 512. The top end of the bottom cover 512 extends upward in the axial direction of the bottom cover 512 to form a positioning portion 5123.

The sealing member 513 has a substantially cylindrical structure. The side wall of the sealing member 513 is provided with a positioning groove 5132 corresponding to the positioning portion 5123. A first sleeve portion 5133 is formed at central portion of the sealing member 513 and passes through two ends of the sealing member 513, and a second sleeve portion 5134 is formed at the lower end of the sealing member 513. The second sleeve portion 5134 communicates with the first sleeve portion 5133, and the inner diameter of the second sleeve portion 5134 is smaller than the inner diameter of the first sleeve portion 5133. A step surface 5135 is formed between the first sleeve portion 5133 and the second sleeve portion 5134. The step surface 5135 is used for closing the liquid outlet opening 5121. The outer diameter of the second sleeve portion 5134 is smaller than the diameter of the liquid outlet opening 5121, so that the second sleeve portion 5134 can pass through the liquid outlet opening 521. The sealing member 513 is slidably mounted on the bottom cover 512 by the engagement of the positioning groove 5132 and the positioning portion 5123. The sealing member 513 is slidably sleeved on the outer wall of the air outlet passage 5111 through the first sleeve portion 5133. The air outlet passage 5111, the first sleeve portion 5133 and the second sleeve portion 5134 are communicated sequentially. The sealing member 513 is provided with two oppositely disposed liquid guiding grooves 5131 communicating with the liquid storage chamber 5112.

One end of the elastic member 514 elastically abuts against the top wall of the liquid storage tube 511, and the other end of the elastic member 514 elastically abuts against the upper end of the sealing member 513. In the natural state, the sealing member 513 is attached to the bottom cover 512 closely under the elastic force of the elastic member 514 to seal the liquid outlet opening 5121 of the bottom cover 512, and the cigarette liquid in the liquid storage chamber 5112 cannot flow out.

In this embodiment, the sealing member 513 is made of a plastic material. It is understood that the sealing member 513 can also be made of a silicone material to improve the sealing property and prevent the leakage of the cigarette liquid.

Further, the liquid storage assembly 51 further includes a pressing plate 515 disposed on the upper surface of the sealing member 513. The pressing plate 515 is provided with liquid passing holes (not shown) corresponding to the liquid guiding grooves 5131. One end of the elastic member 514 near the sealing member 513 elastically resists on the pressing plate 515. The pressing plate 515 is made of a hard material such as plastic, metal, ceramic, and the like. Since the material of the sealing member 513 is soft, the pressing plate 515 is disposed on the sealing member 513 to increase the strength of the sealing member 513, so that the sealing member 513 is less likely to be deformed, thereby avoiding liquid leakage.

Figure 24:
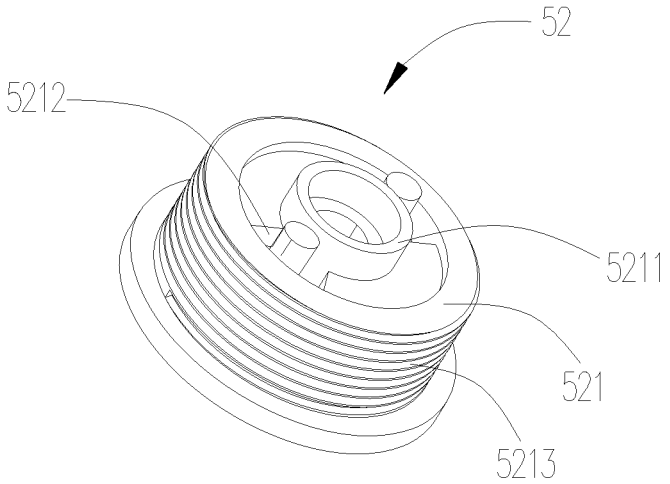
FIG. 24 is an enlarged view of the atomizing assembly of the electronic cigarette shown in FIG. 23.

Referring to FIG. 24, the atomizing assembly 52 includes a pushing member 521, and a liquid guiding member (not labeled) and a heating member (not labeled) which are received in the pushing member 521.

The pushing member 521 has a substantially hollow cylindrical structure. The inner space of the pushing member 521 forms an atomizing chamber 5214. The upper end of the pushing member 521 extends upward in the axial direction of the pushing member 521 to form a pushing portion 5211 capable of passing through the liquid outlet opening 5121. The upper surface of the pushing member 521 is provided with two oppositely disposed through holes 5212 surrounding the pushing portion 5211 and communicating with the atomizing chamber 5214.

Further, the liquid guiding member is disposed corresponding to the through holes 5212, and the heating member surrounds the liquid guiding member.

Further, the outer wall of the pushing member 521 is provided with an external thread 5213 used for matching with the internal thread 5122.

The power supply device 502 is fixedly connected to the pushing member 521, and the battery (not shown) in the power supply device 502 is electrically connected to the heating member, so that the cigarette liquid absorbed by the liquid guiding member is atomized into smoke in the atomizing chamber 5214 by the heating member under electric driving.

Figure 26:
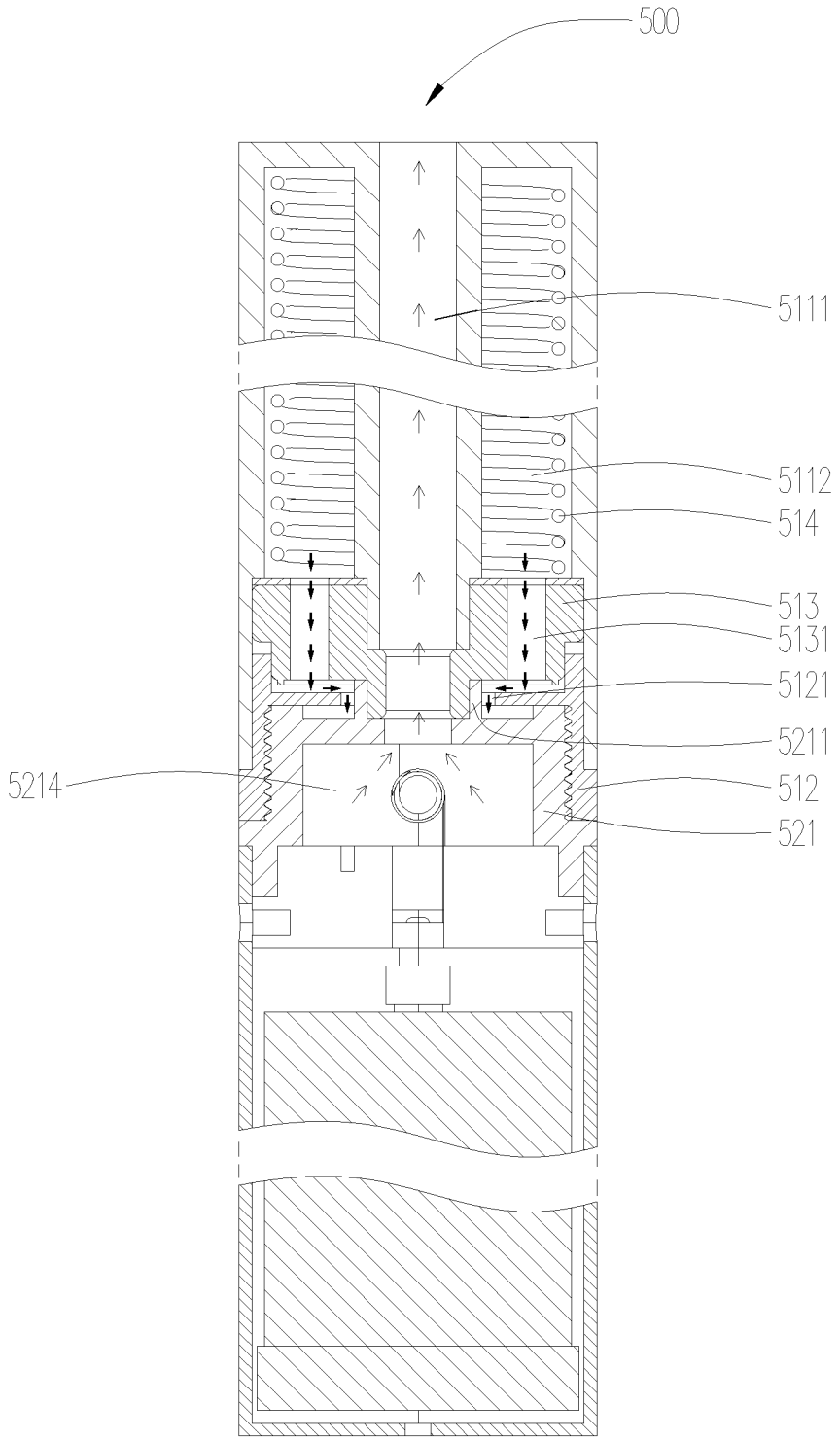
FIG. 26 is a cross-sectional view of the electronic cigarette of FIG. 23 (the liquid storage chamber is opened)

Referring to FIG. 25, when the atomizing assembly 52 is connected to the liquid storage assembly 51, the external thread 5213 of the pushing member 521 is screwed with the internal thread 5122 of the bottom cover 512. During the screwing process, the pushing member 521 is moved upward, the pushing portion 5211 contacts the sealing member 513, and the sealing member 513 is driven by the pushing member 521 to move upwardly and compress the elastic member 514, so that the sealing member 513 is separated from the bottom cover 512, and the liquid outlet opening 5121 of the bottom cover 512 is opened. After the atomizing assembly 52 is connected to the liquid storage assembly 51, the pushing portion 5211 is sleeved on the second sleeve portion 5134, so that the air outlet passage 5111 communicates with the atomizing chamber 5214 through the second sleeve portion 5134. The cigarette liquid in the liquid storage chamber 5112 enters into the gap between the sealing member 513 and the bottom cover 512 through the liquid guiding grooves 5131, then flows out from the liquid outlet opening 5121 of the bottom cover 512, and is absorbed by the liquid guiding member through the through holes 5212 to be atomized into smoke. The direction indicated by the thick arrow in FIG. 26 is the flow direction of the cigarette liquid.

When the user inhales, the external air enters the atomizing chamber 5214 to mix with the smoke, and then reaches the user's mouth via the second sleeve portion 5134 and the air outlet passage 5111. The direction indicated by the thin arrow in FIG. 26 is the flow direction of the airflow.

When the atomizing assembly 52 is detached and separated from the liquid storage assembly 51, the pushing member 521 is separated from the sealing member 513, and the sealing member 513 moves downward under the restoring action of the elastic member 514, so that the sealing member 513 abuts on the bottom cover 512 again to seal the liquid outlet opening 5121, and the cigarette liquid in the liquid storage chamber 5112 cannot flow out.

It is understood that the pressing plate 515 can also be omitted. At this time, one end of the elastic member 514 directly elastically resists the sealing member 513. When the sealing member 513 moves, the sealing member 513 can compress the elastic member 514 or the sealing member 513 can reset under the elastic force of the elastic member 514.

In the atomizer 501 of the fifth embodiment of the present disclosure, even if the liquid storage assembly 51 and the atomizing assembly 52 are detached and separated, the sealing member 513 can automatically seal the liquid storage chamber 5112 under the restoring action of the elastic member 514 to prevent the liquid from flowing out. It effectively avoids the occurrence of children's contact and even ingestion of the cigarette liquid, thereby having an effective child protection function.

The fifth embodiment of the present disclosure further provides an electronic cigarette 500 including the atomizer 501 described above. The electronic cigarette 500 has all the technical features of the atomizer 501, and thus has the same technical effects as the atomizer 501.

Sixth Embodiment

Figure 27:
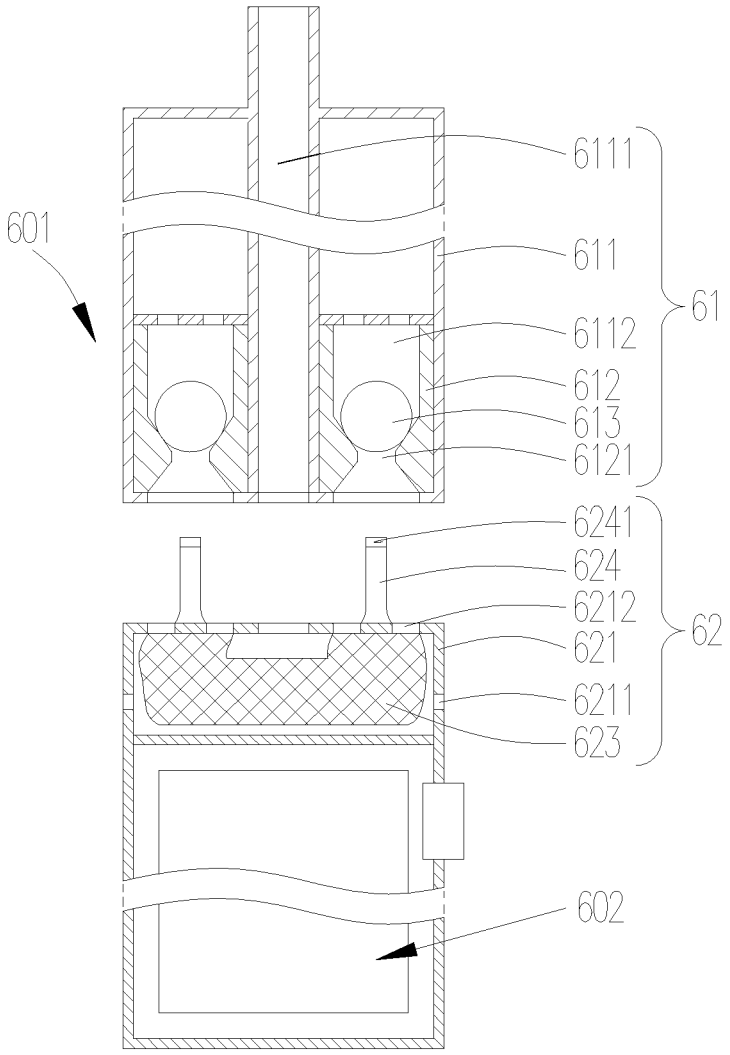
FIG. 27 is a partially exploded view of an electronic cigarette according to a sixth embodiment of the present disclosure (the liquid storage chamber is sealed)
Figure 28:
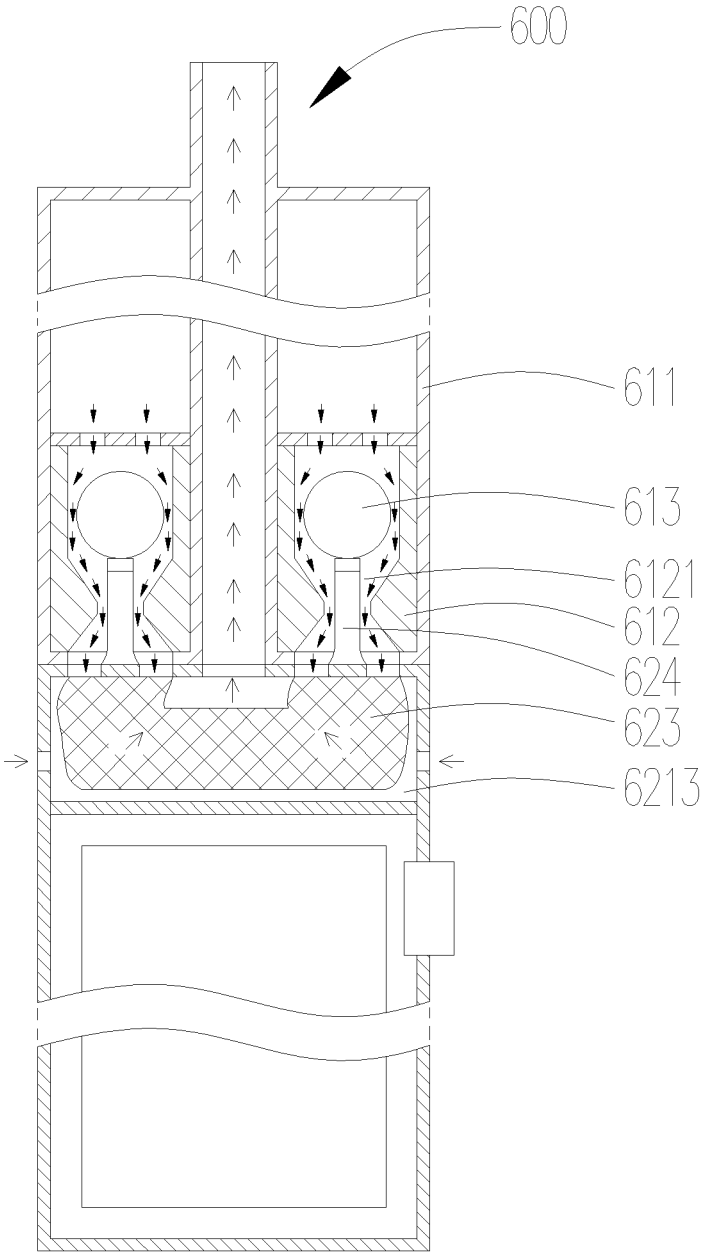
FIG. 28 is a schematic view showing the structure of the electronic cigarette shown in FIG. 27 (the liquid storage chamber is opened).

Referring to FIG. 27 and FIG. 28, the sixth embodiment of the present disclosure provides an electronic cigarette 600. The electronic cigarette 600 includes an atomizer 601 and a power supply device 602 connected to the atomizer 601. The atomizer 601 includes a liquid storage assembly 61 and an atomizing assembly 62 detachably connected to the liquid storage assembly 61.

The liquid storage assembly 61 includes a liquid storage tube 611, a stopper 612 provided at one end of the liquid storage tube 611, and a sealing member 613 movably received in the liquid storage tube 611.

The liquid storage tube 611 has a tubular hollow structure with an opening at the lower end. The inside of the liquid storage tube 611 is provided with a tubular air outlet passage 6111 extending through the liquid storage tube 611 along the axial direction of the liquid storage tube 611. The space between the outer wall of the air outlet passage 6111 and the inner wall of the liquid storage tube 611 forms a liquid storage chamber 6112 for storing the cigarette liquid.

The stopper 612 has a cylindrical structure, and the stopper 612 is mounted at the open end of the liquid storage tube 611 by an interference fit. The stopper 612 is provided with two liquid outlet openings 6121 which are oppositely disposed and communicate with the liquid storage chamber 6112. It is understood that the liquid outlet opening 6121 can also be only one or more than two.

Further, the stopper 612 is made of a soft material such as rubber or silicone, and the liquid outlet opening 6121 is a tapered opening.

The sealing member 613 can be stopped by the liquid outlet opening 6121 on the stopper 612 to seal the liquid storage chamber 6112.

Further, the sealing member 613 is made of a magnetic material. In this embodiment, the sealing member 613 is a steel ball. It is understood that the sealing member 613 can also be a steel sheet, a tapered steel plug, or the like.

The atomizing assembly 62 includes a casing 621, a liquid guiding and heating structure 623 received in the upper portion of the casing 621, and a pushing member 624 fixed to the upper end of the casing 621.

The casing 621 has a cylindrical structure. The inside of the casing 621 is provided with an atomizing chamber 6213. The liquid guiding and heating structure 623 is disposed in the atomizing chamber 6213. The side wall of the casing 621 is provided with an air inlet hole 6211 communicating with the atomizing chamber 6213. The upper surface of the casing 621 is provided with a plurality of liquid inlet holes 6212 communicating with the liquid outlet opening 6121 and the atomizing chamber 6213.

The liquid guiding and heating structure 623 includes a liquid guiding member (not labeled) and a heating member (not labeled) surrounded by the liquid guiding member. The liquid guiding member is used for absorbing the cigarette liquid, and the heating member is used for atomizing the cigarette liquid into smoke. Specifically, the power supply device 602 is received in the casing 621 and located below the liquid guiding and heating structure 623, and the heating member is electrically connected to the power supply device 602.

The pushing members 624 are disposed corresponding to the liquid outlet openings 6121, and each pushing member 624 corresponds to one liquid outlet opening 6121. Further, one end of the pushing member 624 away from the casing 621 is provided with a magnetic attraction portion 6241 capable of magnetically attracting the sealing member 613. The magnetic attraction portion 6241 is made of a magnetic material.

Referring to FIG. 28, when the atomizing assembly 62 is connected to the liquid storage assembly 61, the pushing member 624 is moved upward until the magnetic attraction portion 6241 attracts and drives the sealing member 613 to move upwardly. At this time, the liquid outlet opening 6121 is opened, and the cigarette liquid in the liquid storage chamber 6121 is absorbed by the liquid guiding and heating structure 623 through the liquid outlet opening 6121 and the liquid inlet hole 6212 and is atomized into smoke. The direction indicated by the thick arrow in FIG. 28 is the flow direction of the cigarette liquid.

When the user inhales, the external air enters the atomizing chamber 6213 through the air inlet hole 6211, mixes with the smoke and then reaches the user's mouth through the air outlet passage 6111. The direction indicated by the thin arrow in FIG. 28 is the flow direction of the airflow.

When the atomizing assembly 62 is detached from the liquid storage assembly 61, the sealing member 613 moves downward under the action of the magnetic force of the pushing member 624 until it is stopped by the stopper 612. At this time, the sealing member 613 seals the liquid outlet opening 6121, and the cigarette liquid in the liquid storage chamber 6112 cannot flow out. Meanwhile, since the stopper 612 is made of a soft material such as rubber or silica gel, the sealing member 613 can closely seal the liquid outlet opening 6121 to further prevent leakage, as shown in the state of FIG. 27.

It is understood that the stopper 612 can also be made of a hard material, and a magnetic member (not shown) capable of attracting the sealing member 613 is provided near the liquid outlet opening 6121. When the atomizing assembly 62 is detached from the liquid storage assembly 61 and the pushing member 624 is separated from the sealing member 613, the sealing member 613 can be attracted to seal the liquid outlet opening 6121 under the magnetic force of the magnetic member.

It is understood that the sealing member 613 is made of a material having a density greater than the density of the cigarette liquid to reduce the floating of the sealing member 613, so that the sealing effect of the sealing member 613 is better.

In the atomizer 601 or the electronic cigarette 600 of the sixth embodiment of the present disclosure, when the atomizing assembly 62 is separated from the liquid storage assembly 61, the sealing member 613 can be reset due to the magnetic force of the pushing member 624, to seal the liquid storage chamber 6112 again and avoid the outflow of the cigarette liquid. It effectively avoids the occurrence of children's contact or even ingestion of the cigarette liquid, thereby having certain safety protection function.

In view of the above-described embodiments of the present disclosure, various changes and modifications can be made by those skilled in the art without departing from the scope of the present disclosure. The scope of the present disclosure is not limited to the contents of the specification, and the scope thereof should be determined in accordance with the scope of the claims.

The invention claimed is:

1. An atomizer comprising a liquid storage assembly and an atomizing assembly, wherein the liquid storage assembly comprises a liquid storage tube internally provided with a liquid storage chamber, a liquid outlet opening communicating with the liquid storage chamber and a sealing member movably received in the liquid storage chamber, the atomizing assembly comprises an atomizing chamber and a pushing member, when the liquid storage assembly and the atomizing assembly are separated, the sealing member is in a first state in which the sealing member seals the liquid outlet opening, when the liquid storage assembly and the atomizing assembly are connected, the pushing member abuts against the sealing member to drive the sealing member to move to a second state in which the sealing member is at least partially separated from the liquid outlet opening so that the liquid outlet opening is opened and the liquid storage chamber is in communication with the atomizing chamber;

the liquid storage assembly further comprises an elastic member received in the liquid storage chamber, one end of the elastic member elastically abuts against the sealing member, the other end of the elastic member elastically abuts against an inner wall of the liquid storage chamber, when the liquid storage assembly and the atomizing assembly are connected, the pushing member drives the sealing member to compress the elastic member, when the liquid storage assembly and the atomizing assembly are separated, the sealing member is reset to the first state under the elastic force of the elastic member;

the liquid storage tube is further provided internally with at least one air outlet passage, the air outlet passage is isolated from the liquid storage chamber, when the liquid storage assembly and the atomizing assembly are connected, the air outlet passage is in communication with the atomizing chamber;

an inner wall of the liquid storage chamber is provided with a first positioning step, a lower end of the sealing member is provided outwardly with a second positioning step along the circumferential direction of the sealing member for engaging in the liquid outlet opening, one end of the elastic member elastically resists the first positioning step, the other end of the elastic member elastically resists the second positioning step, when the sealing member is in the first state, the second positioning step seals the liquid outlet opening, when the sealing member is in the second state, the second positioning step compresses the elastic member and is separated from the liquid outlet opening.

2. The atomizer according to claim 1, wherein an upper end of the sealing member is provided outwardly with a positioning flange along the circumferential direction of the sealing member, the positioning flange is supported on the first positioning step.

3. The atomizer according to claim 1, wherein the atomizing assembly further comprises an outer sleeve detachably connected to the liquid storage tube, the pushing member is received at an upper end of the outer sleeve, the atomizing chamber is formed by an inner space of the outer sleeve, a first air inlet hole is defined in a side wall of the outer sleeve, an air inlet groove is defined in a side wall of the pushing member, when the outer sleeve and the liquid storage tube are connected, the first air inlet hole, the atomizing chamber, the air inlet groove and the air outlet passage are communicated sequentially.

4. The atomizer according to claim 3, wherein an upper end of the pushing member is provided with a liquid inlet groove, a mounting hole is defined in a side wall of the pushing member along a radial direction of the pushing member and located below the liquid inlet groove, the mounting hole is communicated with the liquid inlet groove and the air inlet groove, when the outer sleeve and the liquid storage tube are connected, the upper end of the pushing member replaces the sealing member to seal the liquid outlet opening such that the mounting hole communicates with the liquid storage chamber through the liquid inlet groove and the air inlet groove communicates with the air outlet passage through the mounting hole.

5. An atomizer comprising a liquid storage assembly and an atomizing assembly, wherein the liquid storage assembly comprises a liquid storage tube internally provided with a liquid storage chamber, a liquid outlet opening communicating with the liquid storage chamber and a sealing member movably received in the liquid storage chamber, the atomizing assembly comprises an atomizing chamber and a pushing member, when the liquid storage assembly and the atomizing assembly are separated, the sealing member is in a first state in which the sealing member seals the liquid outlet opening, when the liquid storage assembly and the atomizing assembly are connected, the pushing member abuts against the sealing member to drive the sealing member to move to a second state in which the sealing member is at least partially separated from the liquid outlet opening so that the liquid outlet opening is opened and the liquid storage chamber is in communication with the atomizing chamber;

the liquid storage assembly further comprises an elastic member received in the liquid storage chamber, one end of the elastic member elastically abuts against the sealing member, the other end of the elastic member elastically abuts against an inner wall of the liquid storage chamber, when the liquid storage assembly and the atomizing assembly are connected, the pushing member drives the sealing member to compress the elastic member, when the liquid storage assembly and the atomizing assembly are separated, the sealing member is reset to the first state under the elastic force of the elastic member;

the liquid storage tube is further provided internally with at least one air outlet passage, the air outlet passage is isolated from the liquid storage chamber, when the liquid storage assembly and the atomizing assembly are connected, the air outlet passage is in communication with the atomizing chamber;

the liquid storage assembly further comprises a bottom cover having an opening at a lower end, the bottom cover is disposed at a lower end of the liquid storage tube, the liquid outlet opening is provided in the upper surface of the bottom cover.

6. The atomizer according to claim 5, wherein the sealing member is provided with a first sleeve portion and a second sleeve portion, the first sleeve portion is slidably sleeved on an outer wall of the air outlet passage, the second sleeve portion is in communication with the air outlet passage, one end of the second sleeve portion opposite to the first sleeve portion passes through the liquid outlet opening, when the sealing member is in the first state, a step surface between the first sleeve portion and the second sleeve portion seals the liquid outlet opening.

7. The atomizer according to claim 5, wherein the atomizing assembly further comprises an atomizing cover, an inner space of the atomizing cover forms the atomizing chamber, the pushing member is received in the atomizing cover, one end of the pushing member passes through an upper end of the atomizing cover, the pushing member is made of a hard material having the ability to absorb cigarette liquid, when the sealing member is in the second state, the pushing member replaces the sealing member to seal the liquid outlet opening and the liquid storage chamber communicates with the atomizing chamber via the pushing member.

8. The atomizer according to claim 7, wherein the atomizing assembly further comprises an atomizing base disposed at a lower end of the atomizing cover and a first electrode mounted at a lower end of the atomizing base, an air outlet hole is provided at an upper end of the atomizing cover, a first air inlet opening is provided in the atomizing base, a second air inlet opening is provided in the first electrode, when the atomizing assembly and the liquid storage assembly are connected, the second air inlet opening, the first air inlet opening, the atomizing chamber, the air outlet hole and the air outlet passage are communicated sequentially.

9. The atomizer according to claim 5, wherein the atomizing chamber is formed by an inner space of the pushing member, a through hole communicating with the atomizing chamber is provided in the pushing member corresponding to the liquid outlet opening.

10. The atomizer according to claim 9, wherein an upper end of the pushing member extends upward in the axial direction of the pushing member to form a pushing portion, the through hole is defined in the upper surface of the pushing member, when the pushing portion passes through the liquid outlet opening to abut against the sealing member, the sealing member is in the second state, and the liquid storage chamber communicates with the atomizing chamber through the liquid outlet opening and the through hole.

11. The atomizer according to claim 1, wherein the liquid storage tube is provided with an opening at a lower end thereof, and the opening at the lower end of the liquid storage tube forms as the liquid outlet opening.

12. The atomizer according to claim 1, wherein a seal ring is disposed between the second positioning step and the bottom of the sealing member.

13. An atomizer comprising a liquid storage assembly and an atomizing assembly, wherein the liquid storage assembly comprises a liquid storage tube internally provided with a liquid storage chamber, a liquid outlet opening communicating with the liquid storage chamber and a sealing member movably received in the liquid storage chamber, the atomizing assembly comprises an atomizing chamber and a pushing member, when the liquid storage assembly and the atomizing assembly are separated, the sealing member is in a first state in which the sealing member seals the liquid outlet opening, when the liquid storage assembly and the atomizing assembly are connected, the pushing member abuts against the sealing member to drive the sealing member to move to a second state in which the sealing member is at least partially separated from the liquid outlet opening so that the liquid outlet opening is opened and the liquid storage chamber is in communication with the atomizing chamber;

the liquid storage assembly further comprises an elastic member received in the liquid storage chamber, one end of the elastic member elastically abuts against the sealing member, the other end of the elastic member elastically abuts against an inner wall of the liquid storage chamber, when the liquid storage assembly and the atomizing assembly are connected, the pushing member drives the sealing member to compress the elastic member, when the liquid storage assembly and the atomizing assembly are separated, the sealing member is reset to the first state under the elastic force of the elastic member;

the liquid outlet opening is defined in a side wall of the liquid storage tube, the sealing member is vertically disposed in the liquid storage chamber, one end of the elastic member elastically abuts against the sealing member, the other end of the elastic member elastically abuts against a side wall of the liquid storage chamber opposite to the liquid outlet opening, a side wall of the sealing member is provided with a resisting portion extending away from the elastic member and slidably passing through the liquid outlet opening, one end of the resisting portion away from the elastic member is provided with a wedge-shaped surface facing downward.

14. An atomizer comprising a liquid storage assembly and an atomizing assembly, wherein the liquid storage assembly comprises a liquid storage tube internally provided with a liquid storage chamber, a liquid outlet opening communicating with the liquid storage chamber and a sealing member movably received in the liquid storage chamber, the atomizing assembly comprises an atomizing chamber and a pushing member, when the liquid storage assembly and the atomizing assembly are separated, the sealing member is in a first state in which the sealing member seals the liquid outlet opening, when the liquid storage assembly and the atomizing assembly are connected, the pushing member abuts against the sealing member to drive the sealing member to move to a second state in which the sealing member is at least partially separated from the liquid outlet opening so that the liquid outlet opening is opened and the liquid storage chamber is in communication with the atomizing chamber;

the liquid storage assembly further comprises an elastic member received in the liquid storage chamber, one end of the elastic member elastically abuts against the sealing member, the other end of the elastic member elastically abuts against an inner wall of the liquid storage chamber, when the liquid storage assembly and the atomizing assembly are connected, the pushing member drives the sealing member to compress the elastic member, when the liquid storage assembly and the atomizing assembly are separated, the sealing member is reset to the first state under the elastic force of the elastic member;

the liquid outlet opening is defined in a side wall of the liquid storage tube, one end of the elastic member elastically abuts against a bottom wall of the sealing member, the other end of the elastic member elastically abuts against a top wall of the liquid storage chamber, a side wall of the sealing member is closely attached to an inner wall of the liquid storage tube having the liquid outlet opening, the side wall of the sealing member is provided with a resisting portion which extends out from the liquid outlet opening and is moveable in the liquid outlet opening upward and downward.

15. An atomizer comprising a liquid storage assembly and an atomizing assembly, wherein the liquid storage assembly comprises a liquid storage tube internally provided with a liquid storage chamber, a liquid outlet opening communicating with the liquid storage chamber and a sealing member movably received in the liquid storage chamber, the atomizing assembly comprises an atomizing chamber and a pushing member, when the liquid storage assembly and the atomizing assembly are separated, the sealing member is in a first state in which the sealing member seals the liquid outlet opening, when the liquid storage assembly and the atomizing assembly are connected, the pushing member abuts against the sealing member to drive the sealing member to move to a second state in which the sealing member is at least partially separated from the liquid outlet opening so that the liquid outlet opening is opened and the liquid storage chamber is in communication with the atomizing chamber;

the liquid storage tube is further provided internally with at least one air outlet passage, the air outlet passage is isolated from the liquid storage chamber, when the liquid storage assembly and the atomizing assembly are connected, the air outlet passage is in communication with the atomizing chamber;

the atomizing assembly further comprises a casing, the pushing member is fixedly disposed at an upper end of the casing, the atomizing chamber is formed by an inner space of the casing, the upper end of the casing is provided with a liquid inlet hole communicating with the atomizing chamber, when the sealing member is in the second state, the liquid storage chamber communicates with the atomizing chamber through the liquid outlet opening and the liquid inlet hole.

16. The atomizer according to claim 15, wherein a magnetic attraction portion is provided at one end of the pushing member away from the casing, the magnetic attraction portion and the sealing member are made of magnetic material.

17. The atomizer according to claim 15, wherein the sealing member is a steel ball, the liquid storage assembly further comprises a stopper provided at one end of the liquid storage tube, the liquid outlet opening is a tapered opening and provided inside the stopper, when the sealing member is in the first state, the sealing member is stopped by the stopper and a circumferential surface of the sealing member seals the liquid outlet opening.

* * * * *